US009452633B2

(12) United States Patent
Nemoto et al.

(10) Patent No.: US 9,452,633 B2
(45) Date of Patent: Sep. 27, 2016

(54) IMAGE FORMING APPARATUS, IMAGE FORMING METHOD, AND PRINTED MATTER

(71) Applicants: Yoshimi Nemoto, Kanagawa (JP); Takahiro Yoshida, Ibaraki (JP)

(72) Inventors: Yoshimi Nemoto, Kanagawa (JP); Takahiro Yoshida, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/627,174

(22) Filed: Feb. 20, 2015

(65) Prior Publication Data

US 2015/0246533 A1 Sep. 3, 2015

(30) Foreign Application Priority Data

Feb. 28, 2014 (JP) ..... 2014-039070

(51) Int. Cl.
*B41J 2/21* (2006.01)
*B42D 25/30* (2014.01)
*B41J 19/20* (2006.01)

(52) U.S. Cl.
CPC ..... *B42D 25/30* (2014.10); *B41J 2/2135* (2013.01); *B41J 19/207* (2013.01)

(58) Field of Classification Search
CPC ..... B41J 2/2135
USPC ..... 347/5, 9, 12, 43, 15
See application file for complete search history.

(56) References Cited

U.S. PATENT DOCUMENTS

2002/0024558 A1* 2/2002 Fujita et al. ..... 347/43
2002/0101465 A1* 8/2002 Maeda ..... 347/12
2012/0044287 A1* 2/2012 Yamaguchi et al. ..... 347/9

FOREIGN PATENT DOCUMENTS

JP 2003-189099 7/2003
JP 2004-209765 7/2004

* cited by examiner

*Primary Examiner* — Lam Nguyen
(74) *Attorney, Agent, or Firm* — Cooper & Dunham LLP

(57) ABSTRACT

An image forming apparatus forms an image on a recording medium by discharging ink droplets onto the recording medium. The image forming apparatus includes a head having a nozzle orifice that discharges ink droplets onto the recording medium, a main-scanning controller that controls the movement of the head in a main-scanning direction, a main-scanning encoder that generates a position signal indicating the position of the head in the main-scanning direction at a certain interval, a timing generating unit that generates a timing signal with a phase shifted from the position signal, a signal output unit that outputs a recording signal of a waveform pattern corresponding to image data at a timing of the timing signal, and a head drive unit that discharges ink droplets from the nozzle orifice in accordance with the recording signal.

11 Claims, 18 Drawing Sheets

IMAGE FORMING APPARATUS, IMAGE FORMING METHOD, AND PRINTED MATTER

CROSS-REFERENCE TO RELATED APPLICATIONS

The present application claims priority to and incorporates by reference the entire contents of Japanese Patent Application No. 2014-039070 filed in Japan on Feb. 28, 2014.

BACKGROUND OF THE INVENTION

1. Field of the Invention

The present invention relates to an image forming apparatus, an image forming method, and printed matter.

2. Description of the Related Art

Inkjet recording apparatuses are known that discharge ink droplets from heads having nozzle orifices to record images on sheets. The inkjet recording apparatuses have been recently progressively downsized and reduced in cost. On the other hand, the inkjet recording apparatuses are also required to provide higher image quality. The inkjet recording apparatuses are required to provide higher image quality by increasing recording density in a main-scanning direction, for example.

For example, Japanese Laid-open Patent Publication No. 2004-209765 discloses an image forming apparatus that has a plurality of kinds of masks that define dot arrangement with recording density of printing image data or more and performs recording with density of the printing image data or more while referring to a randomly selected mask. The image forming apparatus disclosed in Japanese Laid-open Patent Publication No. 2004-209765 further discloses a technique that varies the position of the mask referred to by color, thereby shifting a dot arrangement position by color and enabling a record with main-scanning resolution up to four times higher than that of the printing image data.

In order to increase the recording density in the main-scanning direction in the inkjet recording apparatuses, it is required to improve the accuracy of a linear encoder for detecting the position of a head in the main-scanning direction. However, when the accuracy of the linear encoder is improved in the inkjet recording apparatuses, the linear encoder increases in processing cost or the like, leading to an increased cost as a whole.

In view of the above-described conventional problems, there is a need to provide an image forming apparatus having improved recording density in the main scanning direction at low cost, an image forming method, and print matter.

SUMMARY OF THE INVENTION

It is an object of the present invention to at least partially solve the problems in the conventional technology.

According to the present invention, there is provided an image forming apparatus that forms an image on a recording medium by discharging ink droplets onto the recording medium, the image forming apparatus comprising: a head having a nozzle orifice that discharges ink droplets onto the recording medium; a main-scanning controller that controls the movement of the head in a main-scanning direction; a main-scanning encoder that generates a position signal indicating the position of the head in the main-scanning direction at a certain interval; a timing generating unit that generates a timing signal with a phase shifted from the position signal; a signal output unit that outputs a recording signal of a waveform pattern corresponding to image data at a timing of the timing signal; and a head drive unit that discharges ink droplets from the nozzle orifice in accordance with the recording signal.

The present invention also provides an image forming method executed by an image forming apparatus that forms an image on a recording medium by discharging ink droplets onto the recording medium, the image forming apparatus comprising: a head having a nozzle orifice that discharges ink droplets onto the recording medium; a main-scanning controller that controls the movement of the head in a main-scanning direction; and a main-scanning encoder that generates a position signal indicating the position of the head in the main-scanning direction at a certain interval, the image forming method comprising: generating a timing signal with a phase shifted from the position signal; outputting a recording signal of a waveform pattern corresponding to image data at a timing of the timing signal; and discharging ink droplets from the nozzle orifice in accordance with the recording signal.

The present invention also provides printed matter on which an image is formed by the above-described image forming method.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes embodiments according to the present invention in detail with reference to the drawings. These embodiments do not limit the present invention.

First Embodiment

Figure 1:
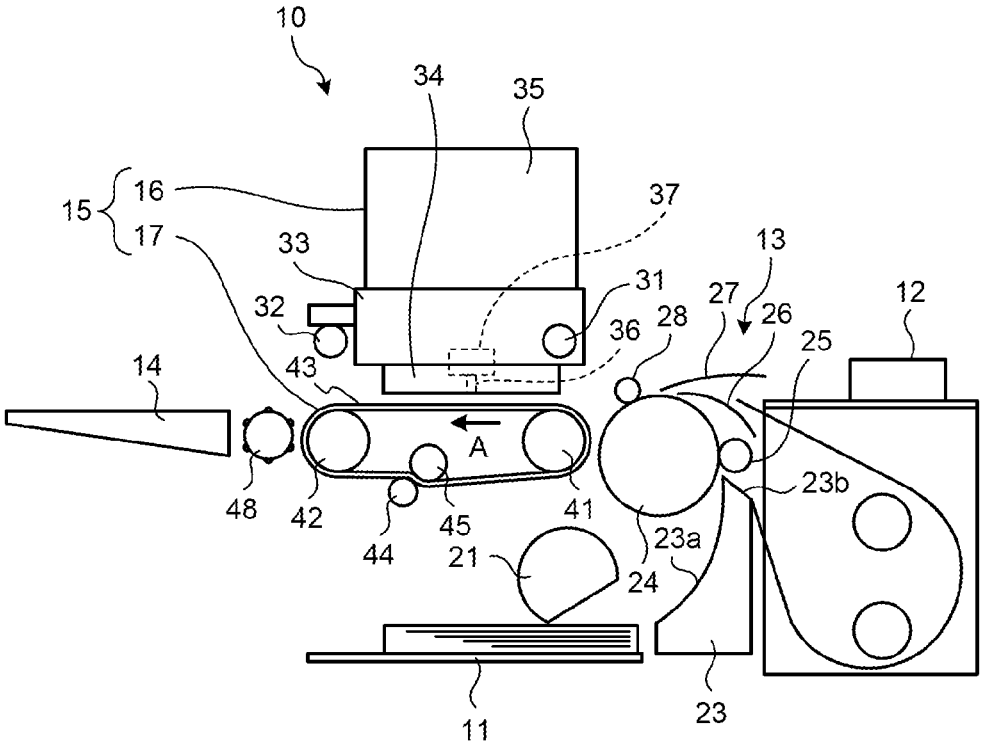
FIG. 1 is a diagram illustrating the structural configuration of an image forming apparatus.

FIG. 1 illustrates a hardware configuration of an image forming apparatus 10 according to the first embodiment. The image forming apparatus 10 discharges ink droplets as liquid droplets onto a sheet (a recording medium) to form an image corresponding to image data onto the sheet. In other words, the image forming apparatus 10 is an image recording apparatus that generates printed matter by the inkjet system.

The image forming apparatus 10 includes a sheet feeding tray 11, a sheet reversing unit 12, a sheet transfer unit 13, a paper ejection tray 14, and an image forming unit 15.

The sheet feeding tray 11 stacks thereon sheets being to be image formed. The sheet reversing unit 12 takes in a sheet and discharges the taken-in sheet with it reversed.

The sheet transfer unit 13 takes therein sheets from the sheet feeding tray 11 one by one and sends the taken-in sheet to the image forming unit 15. The sheet transfer unit 13 takes therein, from the image forming unit 15, a sheet having been completed image formation on one side thereof, and sends the sheet to the sheet reversing unit 12. The sheet transfer unit 13 takes therein the reversed sheet from the sheet reversing unit 12 and sends the taken-in sheet to the image forming unit 15.

The sheet transfer unit 13 includes, as an example, a sheet feeding roller 21, a first guide unit 23, a transfer roller 24, a pressurizing roller 25, a second guide unit 26, a third guide unit 27, and a pressing roller 28.

The sheet feeding roller 21 picks up a sheet from the sheet feeding tray 11 and moves the taken-out sheet along a first guide face 23*a* of the first guide unit 23. The transfer roller 24 transfers, the sheet that has moved along the first guide face 23*a*, to the image forming unit 15. The transfer roller 24 transfers, the sheet that has discharged from the sheet reversing unit 12 and moved along a second guide face 23*b*, to the image forming unit 15. The transfer roller 24 reversely rotates to transfer, the sheet that has been discharged from the image forming unit 15, to the sheet reversing unit 12.

The pressurizing roller 25 nips a sheet between itself and the transfer roller 24 to assist the transfer of the sheet to the image forming unit 15 by the transfer roller 24. The second guide unit 26 guides the sheet that is transferred to the image forming unit 15 by the transfer roller 24. The third guide unit 27 guides the sheet that is transferred from the image forming unit 15 to the sheet reversing unit 12 by the transfer roller 24. The pressing roller 28 nips the sheet between itself and the transfer roller 24 to assist the transfer of the sheet to the image forming unit 15 by the transfer roller 24.

The paper ejection tray 14 stacks thereon sheets on which image formation is completed by the image forming unit 15.

The image forming unit 15, while conveying the sheet transferred from the sheet transfer unit 13, forms an image on the sheet. The image forming unit 15 includes a recording unit 16 and a conveying unit 17.

The recording unit 16 discharges ink droplets onto a sheet, thereby forming an image on the sheet. The conveying unit 17 conveys the sheet in a direction of the arrow A in FIG. 1 to move a position of image formation by the recording unit 16. The conveying unit 17, after the completion of image formation on the sheet, further conveys the sheet in the direction of the arrow A in FIG. 1 and discharges the sheet to the paper ejection tray 14. When images are formed on both sides of the sheet, the conveying unit 17 reversely rotates after the image formation on one side is completed, thereby discharging the sheet in the direction opposite the arrow A in FIG. 1.

The recording unit 16 includes guide shafts 31, 32 and a carriage 33. The guide shafts 31, 32 are hung over the sheet conveyed by the conveying unit 17. The guide shafts 31, 32 hold the carriage 33 movably in a direction perpendicular to a sheet conveyance direction (the direction of the arrow A in FIG. 1) and parallel to the sheet.

The carriage 33 mounts a head 34 thereon. The head 34 includes a nozzle orifice 36 that discharges ink droplets onto the sheet and an inkjet mechanism 37 for discharging (injecting) the ink droplets from the nozzle orifice 36. The inkjet mechanism 37 includes an energy generating unit for discharging ink. The inkjet mechanism 37 may be, as an example, a piezoelectric actuator such as a piezoelectric element or a thermal actuator that uses phase changes caused by film boiling of liquid using an electrothermal conversion element such as a heating resistor. The inkjet mechanism 37 may be, as an example, a shape memory alloy actuator using metal phase changes by temperature changes or an electrostatic actuator using electrostatic force.

Figure 2:
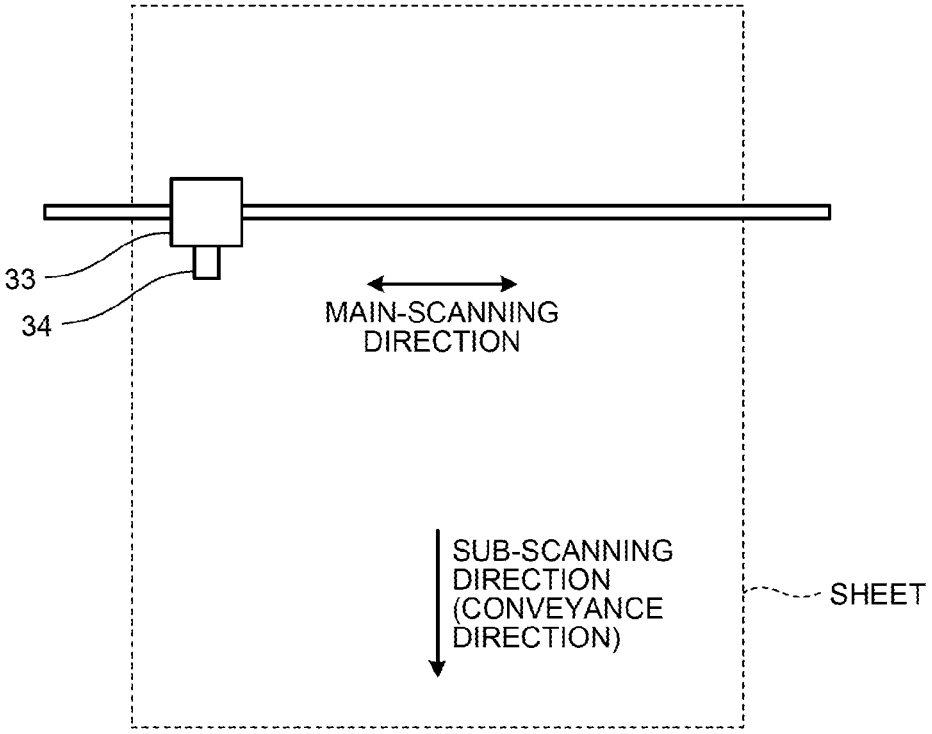
FIG. 2 is a diagram illustrating a moving direction of a head (a main-scanning direction) and a moving direction of a sheet (a sub-scanning direction)
Figure 3:
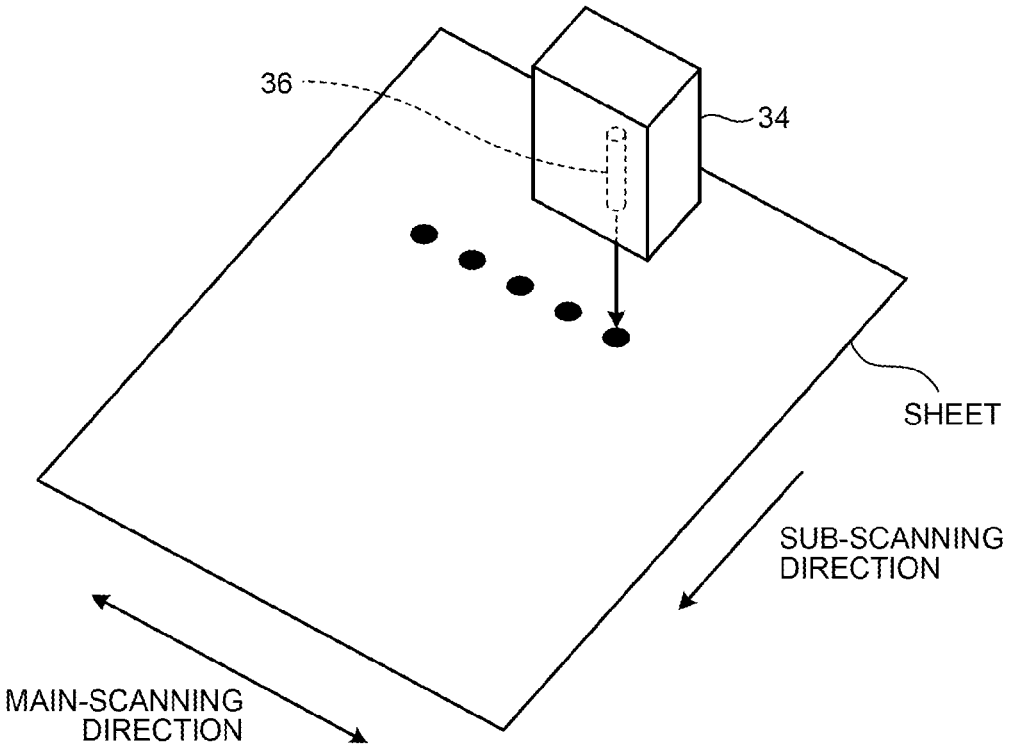
FIG. 3 is a diagram illustrating a situation in which the head is discharging ink droplets onto a sheet to form dots.

The carriage 33 moves along the guide shafts 31, 32 by a drive mechanism such as a motor. As a consequence, as illustrated in FIG. 2, the carriage 33 can move the head 34 in a direction perpendicular to the sheet conveyance direction (a sub-scanning direction) and parallel to the sheet (a main-scanning direction). This structure enables the head 34 to discharge ink droplets from the nozzle orifice 36 at any position in the main-scanning direction on the sheet to form dots as illustrated in FIG. 3.

The sheet is conveyed in the sub-scanning direction by the conveying unit 17. This structure enables the head 34 to discharge ink droplets from the nozzle orifice 36 at any position in the sub-scanning direction on the sheet to form dots.

The carriage 33 mounts an ink cartridge 35 thereon. The ink cartridge 35 holds ink and supplies the ink to the inkjet mechanism 37 of the head 34. The ink cartridge 35 may be attachable and detachable to and from the carriage 33. The carriage 33 may mount a sub tank thereon in place of the ink cartridge 35 to supplementarily supply ink to the sub tank from a main tank.

The conveying unit 17 includes a drive roller 41, a driven roller 42, a conveying belt 43, a charging roller 44, a guide roller 45, and a paper ejection roller 48.

The drive roller 41 rotates by being driven by a motor. The driven roller 42 is a roller to which tension is applied in the direction opposite to the drive roller 41. The conveying belt 43, which is an endless belt, is hung between the drive roller 41 and the driven roller 42. The drive roller 41, the driven roller 42, and the conveying belt 43 move the sheet while maintaining a face of the sheet to be perpendicular to the ink droplets discharged from the head 34.

The conveying belt 43 may have a single-layer structure, a double-layer structure, or a structure having three or more layers. The conveying belt 43 may have, as an example, a double-layer structure having a surface layer as a sheet adsorption face formed of a pure resin material for which no resistance control is performed having a thickness of about 40 μm such as a pure ETFE material and a back layer (an intermediate resistance layer or a grounding layer) formed of the same material as that of the surface layer and for which resistance control by carbon is performed.

The charging roller 44 is in contact with the surface layer of the conveying belt 43 to rotate in accordance with the rotation of the conveying belt 43. A high voltage is applied in a certain pattern from a high-voltage circuit (a high-voltage power supply) to the charging roller 44 that charges the conveying belt 43. The guide roller 45 is arranged facing the charging roller 44 with the conveying belt 43 interposed therebetween.

The paper ejection roller 48 is arranged at the downstream side of the conveying belt 43 to send the sheet on which an image is formed to the paper ejection tray 14. The conveying unit 17 may include a guide member (a platen plate) for guiding the conveying belt 43, a cleaning roller having a porous body or the like for removing ink adhering to the conveying belt 43, for example.

In the thus described image forming unit 15, the conveying belt 43 goes around in the direction of the arrow A in FIG. 1 (the conveyance direction) and comes into contact with the charging roller 44, thereby being charged at high potential. In this case, a voltage is applied to the charging roller 44 while switching its polarity at a certain time interval. This application charges the conveying belt 43 with a pattern of switching its polarity at a certain charging pitch.

The sheet is sent onto the conveying belt 43 thus charged at high potential. Electric charges having a polarity opposite the electric charges on the conveying belt 43 are induced on the surface of the sheet being in contact with the charging roller 44, thereby causing polarization within the sheet. The electric charges on the conveying belt 43 and the electric charges induced on the surface being in contact with the conveying belt 43 electrostatically attract each other, thereby causing the sheet to be electrostatically adsorbed to the conveying belt 43. As a result, the sheet strongly sticks to the conveying belt 43, whereby its curling and irregularities are calibrated and its planarity is maintained.

The image forming unit 15 causes the conveying belt 43 to go around and move the sheet in the sub-scanning direction and drives the head 34 based on a recording signal corresponding to image data while moving the carriage 33 in the main-scanning direction. This mechanism enables the image forming unit 15 to discharge (eject) ink droplets from the head 34, cause the ink droplets to impact certain positions of the stationary sheet, and form dots.

Figure 4:
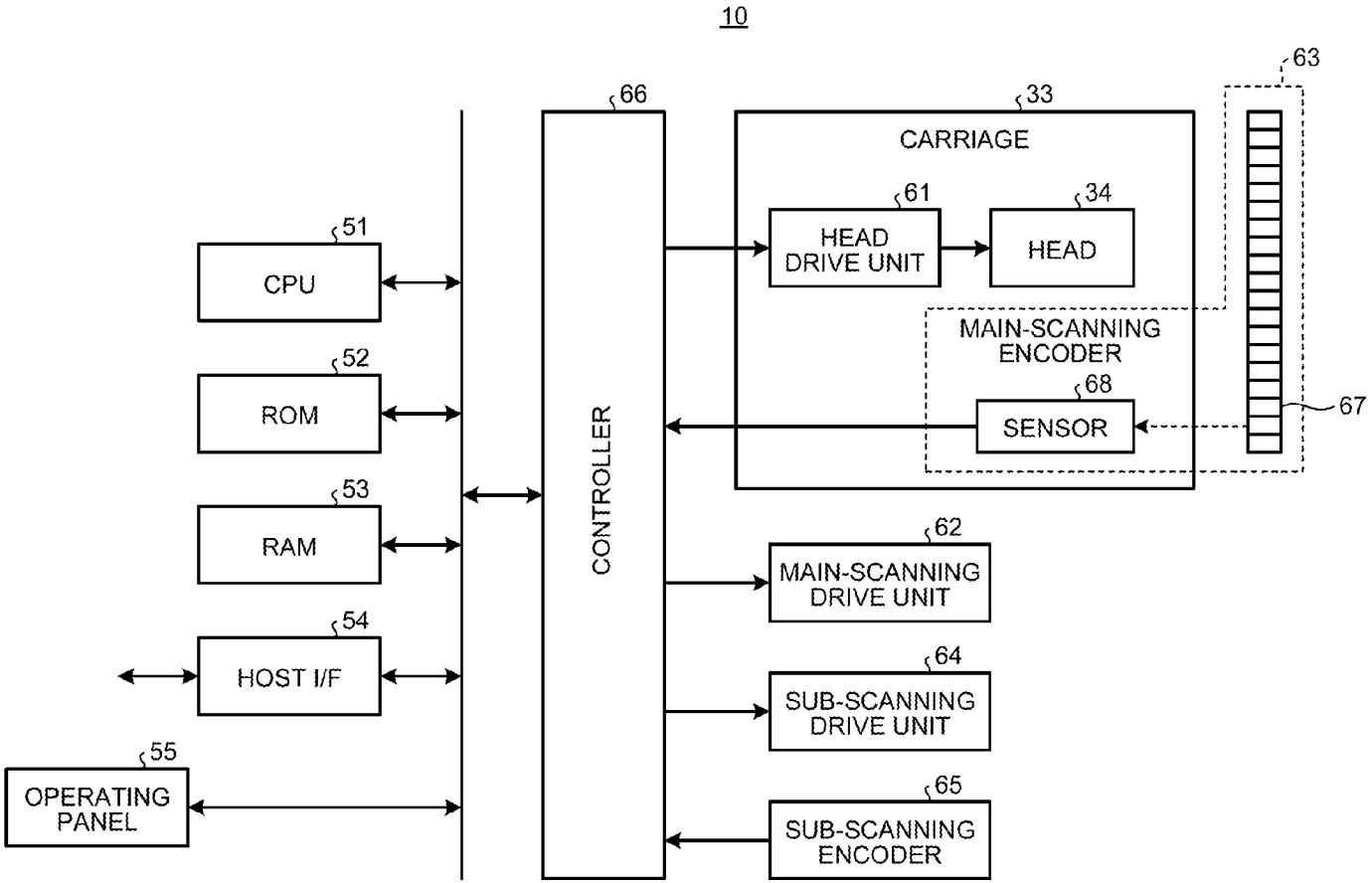
FIG. 4 is a diagram illustrating the electric configuration of the image forming apparatus.

FIG. 4 is a diagram illustrating an electric configuration of the image forming apparatus 10 according to the first embodiment. The image forming apparatus 10 includes a central processing unit (CPU) 51, a read only memory (ROM) 52, a random access memory (RAM) 53, a host I/F 54, an operating panel 55, a head drive unit 61, a main-scanning drive unit 62, a main-scanning encoder 63, a sub-scanning drive unit 64, a sub-scanning encoder 65, and a controller 66.

The CPU 51 controls the whole of the image forming apparatus 10. The ROM 52 is a non-volatile storage device that stores therein programs executed by the CPU 51, other parameters, and the like. The RAM 53 is a volatile storage device as a work area for data processing by the CPU 51. The host I/F 54 transmits and receives image data or the like to and from an external computer or the like. The operating panel 55 receives operation information input by a user and displays various kinds of information to be provided to the user.

The head drive unit 61 is mounted on the carriage 33 together with the head 34. The head drive unit 61 receives inputs of a recording signal from the controller 66. The head drive unit 61 drives the inkjet mechanism 37 in accordance with a waveform pattern of the input recording signal and discharges ink droplets from the nozzle orifice 36 of the head 34.

The main-scanning drive unit 62 receives inputs of a control signal from the controller 66 and moves the carriage 33 in the main-scanning direction in accordance with the input control signal. More specifically, the main-scanning drive unit 62 includes a motor that rotates in accordance with the control signal from the controller 66 and a belt that converts the rotation of the motor into linear movement in the main-scanning direction, for example.

The main-scanning encoder 63 generates a position signal indicating the position of the head 34 in the main-scanning direction at a certain interval. The main-scanning encoder 63, as an example, outputs a position signal of a pulse waveform every time the head 34 moves in the main-scanning direction by a certain interval. The interval at which the main-scanning encoder 63 generates the pulse corresponds to the accuracy of position detection in the main-scanning direction by the main-scanning encoder 63. In the present embodiment, the main-scanning encoder 63 generates the pulse waveform every time the head 34 moves by an interval corresponding to 1,200 dpi. The main-scanning encoder 63 thus described outputs the position signal of a pulse waveform with a constant cycle by the movement of the head 34 in the main-scanning direction at a constant speed.

Figure 5:
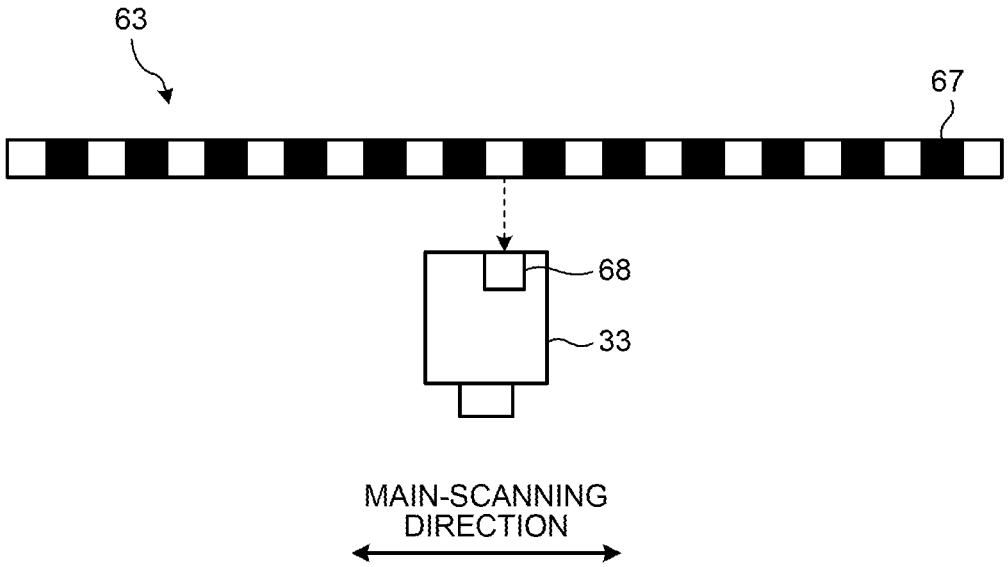
FIG. 5 is a diagram illustrating the configuration of a main-scanning encoder.

As illustrated in FIG. 5, the main-scanning encoder 63 includes a scale 67 fixed in parallel to the main-scanning direction and a sensor 68 mounted on the carriage 33. The scale 67 is formed with graduations (optical or magnetic graduations, for example) at constant intervals (each of intervals corresponding to 1,200 dpi, for example) in the main-scanning direction. The interval of the graduations corresponds to the accuracy of the main-scanning encoder 63. The sensor 68 reads the graduations formed on the scale 67 optically or magnetically, for example, by the movement of the head 34 in the main-scanning direction and generates pulses at positions where the graduations are read. The main-scanning encoder 63 may be an optical type, a magnetic type, or any other type.

The sub-scanning drive unit 64 receives inputs of a control signal from the controller 66 and moves the sheet in the sub-scanning direction in accordance with the input control signal. More specifically, the sub-scanning drive unit 64 includes a motor that rotates the drive roller 41 so that the sheet held by the conveying belt 43 moves in the sub-scanning direction.

The sub-scanning encoder 65 generates a sub-scanning position signal indicating the position of the sheet in the sub-scanning direction at a certain interval. The sub-scanning encoder 65, as an example, outputs a position signal of a pulse waveform every time the sheet moves in the sub-scanning direction by a certain interval. The interval at which the sub-scanning encoder 65 generates the pulse corresponds to the accuracy of position detection in the sub-scanning direction by the sub-scanning encoder 65. In the present embodiment, the sub-scanning encoder 65 outputs the sub-scanning position signal of the pulse waveform every time the sheet rotates by a rotation amount corresponding to 1,200 dpi.

The controller 66 receives inputs of image data to be printed from the CPU 51, generates a recording signal of a waveform pattern corresponding to the input image data, and supplies the recording signal to the head drive unit 61. The controller 66 gives the respective control signals to the main-scanning drive unit 62 and the sub-scanning drive unit 64 in accordance with the respective position signals from the main-scanning encoder 63 and the sub-scanning encoder 65 and controls the position of the head 34 in the main-scanning direction and the position of the sheet in the sub-scanning direction. The controller 66 supplies the recording signal to the head drive unit 61, thereby discharging ink droplets corresponding to the recording signal from the nozzle orifice 36 of the head 34 at the respective positions of the sheet in the main-scanning direction and the sub-scanning direction.

The above-described image forming apparatus 10 can form an image corresponding to image data input from an external computer or the like on the sheet.

Figure 6:
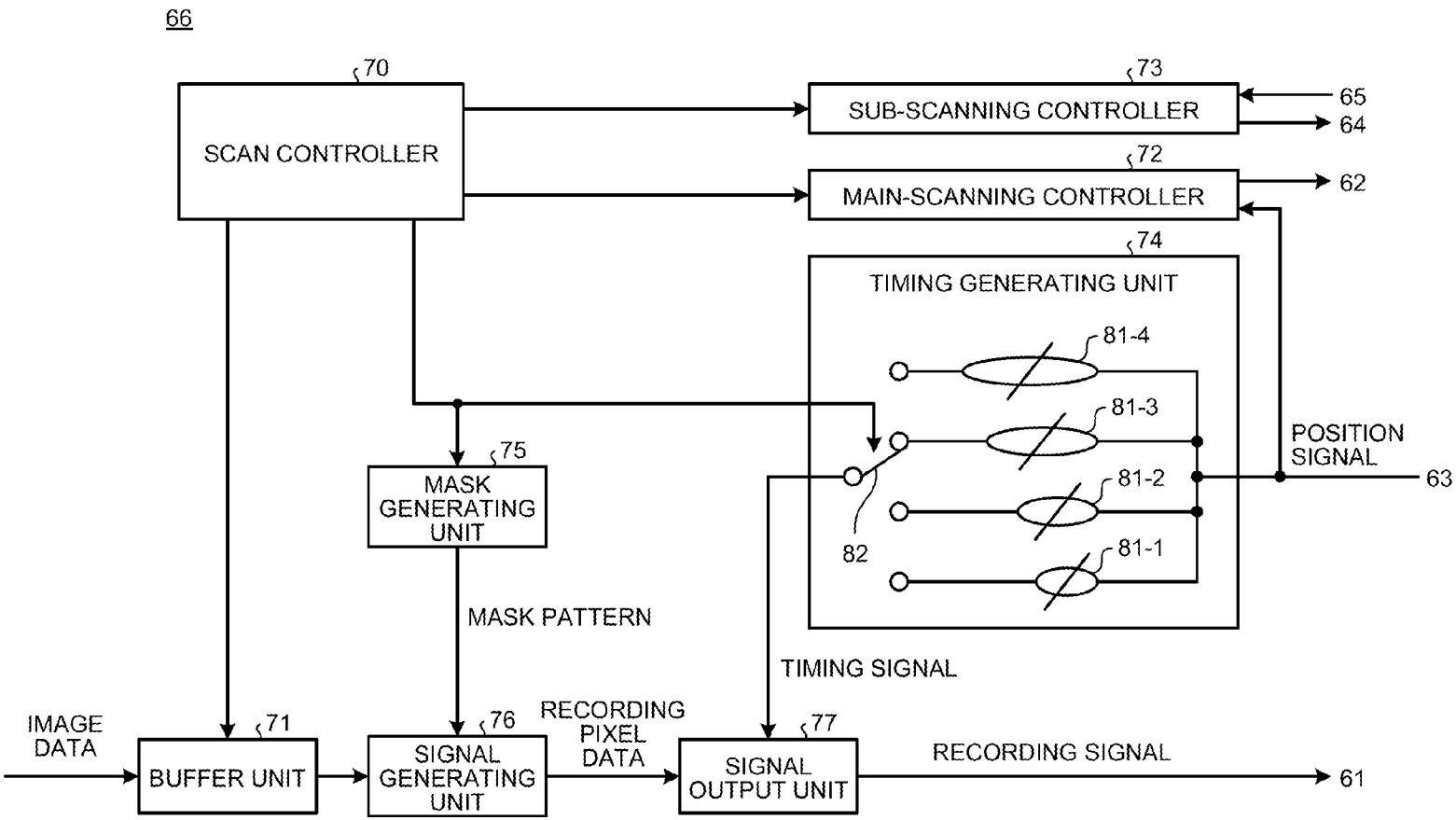
FIG. 6 is a diagram illustrating the configuration of a controller according to a first embodiment.

FIG. 6 is a diagram illustrating the configuration of the controller 66 according to the first embodiment. The controller 66 includes a scan controller 70, a buffer unit 71, a main-scanning controller 72, a sub-scanning controller 73, a timing generating unit 74, a mask generating unit 75, a signal generating unit 76, and a signal output unit 77.

The scan controller 70 controls a position at which an ink droplet is discharged by the head 34. Specifically, the scan controller 70 controls the position in the sub-scanning direction and the position in the main-scanning direction of the nozzle orifice 36 of the head 34 with respect to the sheet. In the present embodiment, the scan controller 70 controls the buffer unit 71, the main-scanning controller 72, the sub-scanning controller 73, the timing generating unit 74, the mask generating unit 75, and the signal generating unit 76 so as to cause the nozzle orifice 36 to perform scans N times (N is an integer of 2 or larger) in the main-scanning direction at the same position in the sub-scanning direction.

The buffer unit 71 externally receives inputs of image data and temporarily stores therein the image data. The buffer unit 71 outputs image data of a line corresponding to the position of the nozzle orifice 36 of the head 34 in the sub-scanning direction to the signal generating unit 76 in accordance with the control by the scan controller 70.

The main-scanning controller 72 gives a control signal to the main-scanning drive unit 62 based on the position signal output from the main-scanning encoder 63 and the control by the scan controller 70 to control the movement of the head 34 in the main-scanning direction. The main-scanning controller 72, as an example, moves the head 34 in the main-scanning direction at a predetermined speed in accordance with the position signal from the main-scanning encoder 63.

The sub-scanning controller 73 gives a control signal to the sub-scanning drive unit 64 based on the position signal output from the sub-scanning encoder 65 and the control by the scan controller 70 to control the movement of the sheet in the sub-scanning direction. The sub-scanning controller 73 moves the sheet in the sub-scanning direction in a period other than that of the moving of the head 34 in the main-scanning direction. In other words, the main-scanning controller 72 moves the head 34 in the main-scanning direction while the sheet is stationary. The sub-scanning controller 73 can move the sheet with the accuracy of detecting the position in the sub-scanning direction by the sub-scanning encoder 65. In the present embodiment, the accuracy of the sub-scanning encoder 65 is 1,200 dpi. The sub-scanning controller 73 can therefore move the sheet in the sub-scanning direction with an accuracy of 1,200 dpi.

The timing generating unit 74 acquires the position signal from the main-scanning encoder 63 and generates a timing signal obtained by shifting the phase of the acquired position signal. The timing generating unit 74, as an example, generates the timing signal by delaying the position signal by a period of time shorter than the cycle of the pulses generated by detecting the graduations formed on the scale 67 by the sensor 68 of the main-scanning encoder 63 while the head 34 is moving in the main-scanning direction at a constant speed.

In the present embodiment, the timing generating unit 74 generates timing signals having different phases for respective N scans at the same position in the sub-scanning direction. More specifically, the timing generating unit 74 generates timing signals with phases shifted by 1/N cycle each with respect to the occurrence cycle of the pulse of the position signal for the respective N scans at the same position in the sub-scanning direction.

When N=4, for example, the timing generating unit 74 may include a first delay unit 81-1, a second delay unit 81-2, a third delay unit 81-3, a fourth delay unit 81-4, and a switching unit 82. The first delay unit 81-1 outputs a first timing signal with no phase shift from the position signal. The second delay unit 81-2 outputs a second timing signal with a phase shifted from the position signal by ¼ cycle. The third delay unit 81-3 outputs a third timing signal with a phase shifted from the position signal by ½ cycle. The fourth delay unit 81-4 outputs a fourth timing signal with a phase shifted is from the position signal by ¾ cycle.

The switching unit 82 outputs any one of the first to fourth timing signals and gives it to the signal output unit 77 in accordance with the control by the scan controller 70. The switching unit 82, as an example, outputs the first timing signal at the first scan in the N scans, outputs the second timing signal at the second scan, outputs the third timing signal at the third scan, and outputs the fourth timing signal at the fourth scan. The thus configured timing generating unit 74 can output the first to fourth timing signals with phases shifted by 1/N cycle each with respect to the occurrence cycle of the pulse of the position signal.

The mask generating unit 75 stores therein N kinds of mask patterns generated in advance and selects and outputs mask patterns corresponding to the respective N scans in accordance with the control by the scan controller 70. More specifically, the mask generating unit 75 extracts a pixel value of a position corresponding to the phase of the timing signal from the image data output from the buffer unit 71 for each of the N scans at the same position in the sub-scanning direction, thereby generating mask patterns for reducing the pixels in the main-scanning direction to 1/N.

The signal generating unit 76 extracts a pixel value determined by each of the mask patterns generated by the mask generating unit 75 from the image data output from the buffer unit 71 for each of the N scans at the same position in the sub-scanning direction and generates recording pixel data indicating the extracted pixel value. In other words, the signal generating unit 76 extracts a pixel corresponding to the phase of the timing signal from the image data of a line corresponding to the position in the sub-scanning direction of the nozzle orifice 36 for each of the N scans at the same position in the sub-scanning direction and generates recording pixel data indicating the extracted pixel value. The signal generating unit 76 then gives the generated recording pixel data to the signal output unit 77.

The signal output unit 77 receives the timing signal output from the timing generating unit 74 and the recording pixel data generated by the signal generating unit 76 for each of the N scans at the same position in the sub-scanning direction. The signal output unit 77 then outputs a recording signal having a value corresponding to the recording pixel data generated by the signal generating unit 76 in sync with the timing of the timing signal.

The controller 66 supplies the recording signal output from the signal output unit 77 to the head drive unit 61.

Figure 7:
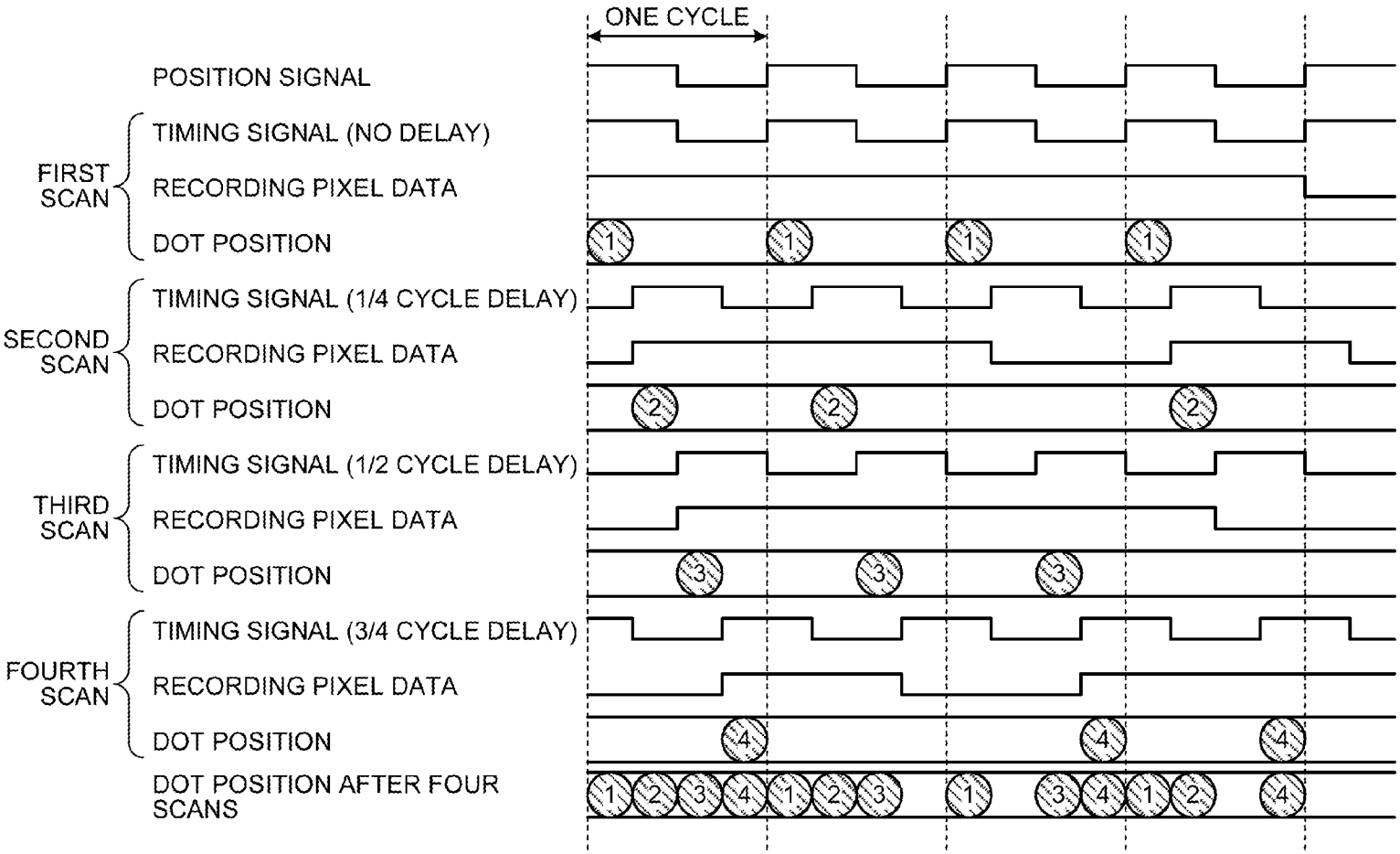
FIG. 7 is a diagram illustrating a relation among a position signal, a timing signal, recording pixel data, and a dot position in the first embodiment.

FIG. 7 is a diagram illustrating a relation among a position signal, a timing signal, recording pixel data, and a dot position when N=4 in the first embodiment.

When N=4, the first timing signal output in the first scan has, for example, no delay with respect to the position signal. The second timing signal output in the second scan is delayed with respect to the position signal by ¼ cycle. The third timing signal output in the third scan is delayed with respect to the position signal by ½ cycle. The fourth timing signal output in the fourth scan is delayed with respect to the position signal by ¾ cycle.

The signal output unit 77 sets the recording signal to be a high level when the recording pixel data is "1" and at a timing of the rise of the timing signal. When the recording signal is the high level, the head drive unit 61 discharges an ink droplet from the nozzle orifice 36. The head drive unit 61 therefore discharges an ink droplet from the nozzle orifice 36 of the head 34 when the recording pixel data is "1" and at a timing of the rise of the timing signal.

The phases of the timing signals in the respective first scan to fourth scan are shifted by ¼ cycle each. The phases of the positions of dots formed in the respective first scan to fourth scan are therefore shifted by ¼ cycle each. This shift enables the controller 66 to form the dots in the main-scanning direction with accuracy four times higher than the accuracy of the position signal output from the main-scanning encoder 63.

Thus, the image forming apparatus 10 according to the present embodiment can improve recording density in the main-scanning direction without changing the main-scanning encoder 63. This improvement enables the image forming apparatus 10 to improve the recording density in the main-scanning direction at low cost.

Second Embodiment

Next, the image forming apparatus 10 according to the second embodiment will be described. Because the image forming apparatus 10 according to the second embodiment has substantially the same configuration as that of the first embodiment, components having substantially the same functions will be referred to by the same reference numerals, and the description thereof will be omitted except for points of difference.

Figure 8:
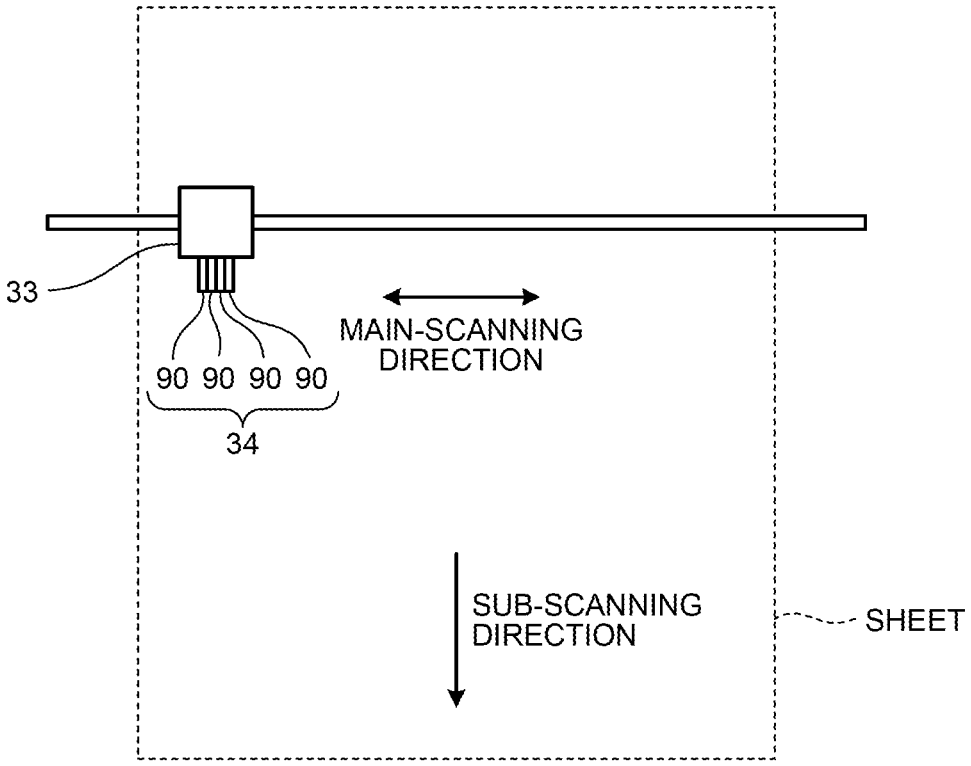
FIG. 8 is a diagram illustrating the configuration of a head mounted on a carriage according to a second embodiment.
Figure 9:
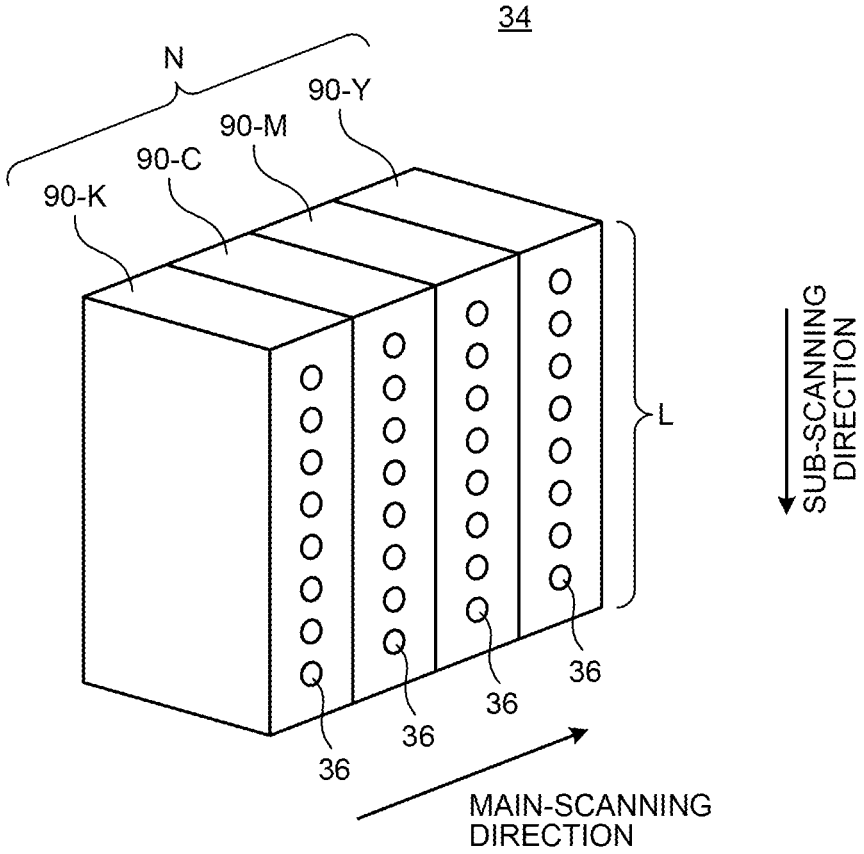
FIG. 9 is a diagram illustrating the configuration of nozzle orifices formed in the head according to the second embodiment.

FIG. 8 is a diagram illustrating the configuration of the head 34 mounted on the carriage 33 according to the second embodiment. FIG. 9 is a diagram illustrating the configuration of the nozzle orifices 36 formed in the head 34 according to the second embodiment.

The head 34 mounted on the carriage 33 according to the second embodiment includes N nozzle units 90 that discharge ink droplets of different colors. Each of the N nozzle units 90 includes L (L is an integer of 2 or larger) nozzle orifices 36. The L nozzle orifices 36 are arranged at least in a row at a certain interval in the sub-scanning direction.

The N nozzle units 90 are arranged in the main-scanning direction. This arrangement causes the N×L nozzle orifices 36 contained in the N nozzle units 90 to be arranged in a matrix in the main-scanning direction and the sub-scanning direction.

In the present embodiment, N=4, and the head 34 includes a nozzle unit 90-K that discharges K-color ink droplets, a nozzle unit 90-C that discharges C-color ink droplets, a nozzle unit 90-M that discharges M-color ink droplets, and a nozzle unit 90-Y that discharges Y-color ink droplets. In the present embodiment, the L nozzle orifices 36 contained in the respective nozzle units 90 are arranged at an interval corresponding to 1,200 dpi, for example. The number of colors, the arrangement order, and the interval of the nozzle orifices 36 are not limiting.

Figure 10:
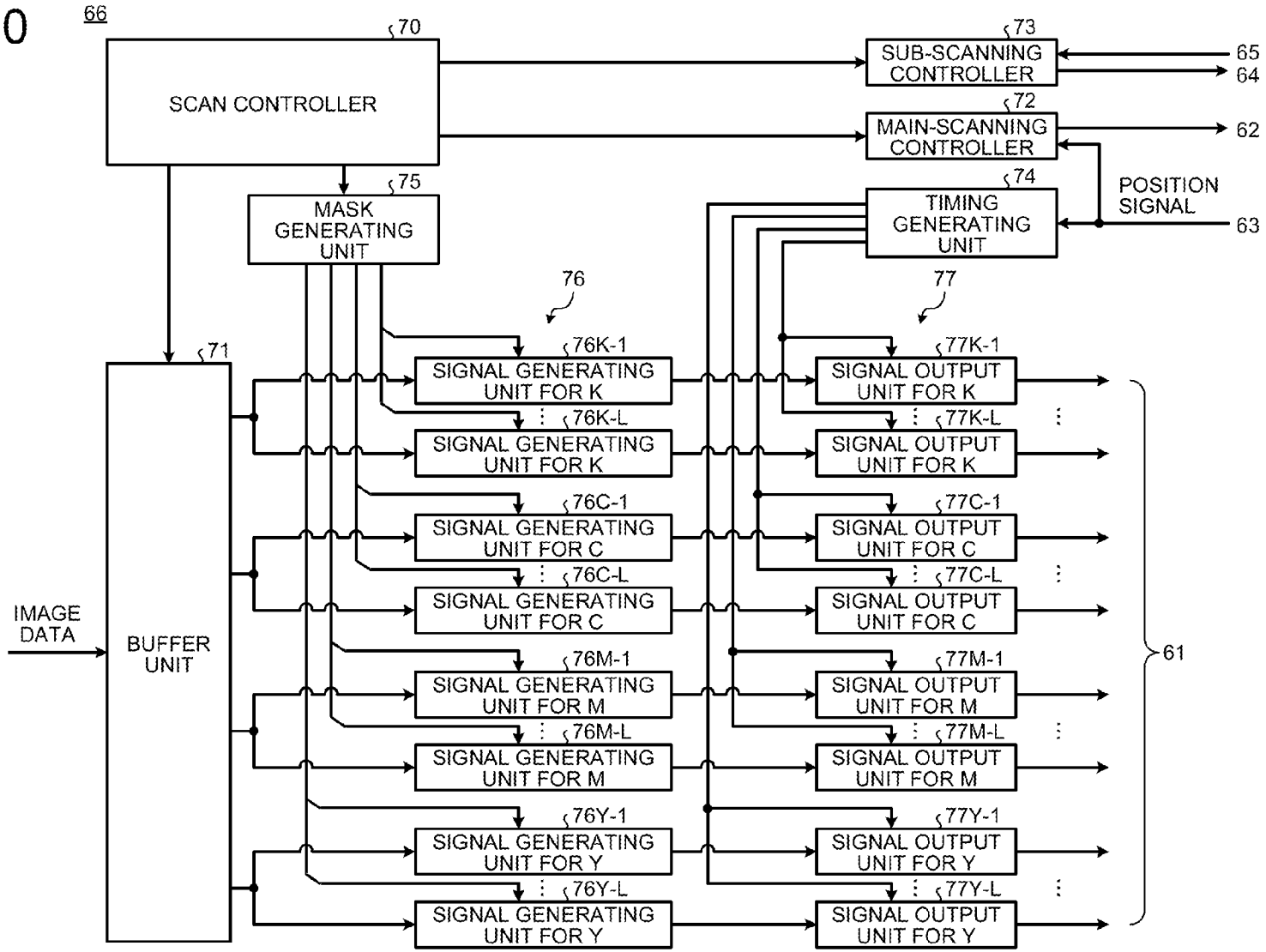
FIG. 10 is a diagram illustrating the configuration of a controller according to the second embodiment.

FIG. 10 is a diagram illustrating the configuration of the controller 66 according to the second embodiment. In the present embodiment, the signal generating unit 76 includes L signal generating units 76K-1 to 76K-L for K, L signal generating units 76C-1 to 76C-L for C, L signal generating units 76M-1 to 76M-L for M, and L signal generating units 76Y-1 to 76Y-L for Y. The signal output unit 77 includes L signal output units 77K-1 to 77K-L for K, L signal output units 77C-1 to 77C-L for C, L signal output units 77M-1 to 77M-L for M, and L signal output units 77Y-1 to 77Y-L for Y.

The L signal generating units 76K-1 to 76K-L for K and the L signal output units 77K-1 to 77K-L for K correspond to the L nozzle orifices 36 of the nozzle unit 90-K for K. The L signal generating units 76C-1 to 76C-L for C and the L signal output units 77C-1 to 77C-L for C correspond to the L nozzle orifices 36 of the nozzle unit 90-C for C. The L signal generating units 76M-1 to 76M-L for M and the L signal output units 77M-1 to 77M-L for M correspond to the L nozzle orifices 36 of the nozzle unit 90-M for M. The L signal generating units 76Y-1 to 76Y-L for Y and the L signal output units 77Y-1 to 77Y-L for Y correspond to the L nozzle orifices 36 of the nozzle unit 90-Y for Y.

In the present embodiment, pieces of image data of respective K, C, M, and Y plates are input to the buffer unit 71.

The buffer unit 71 outputs the data of a line corresponding to the positions of the respective L nozzle orifices 36 in the sub-scanning direction in the K-plate image data to the L signal generating units 76K-1 to 76K-L for K in accordance with the control by the scan controller 70. The buffer unit 71 outputs the data of a line corresponding to the positions of the respective L nozzle orifices 36 in the sub-scanning direction in the C-plate image data to the L signal generating units 76C-1 to 76C-L for C in accordance with the control by the scan controller 70. The buffer unit 71 outputs the data of a line corresponding to the positions of the respective L nozzle orifices 36 in the sub-scanning direction in the M-plate image data to the L signal generating units 76M-1 to 76M-L for M in accordance with the control by the scan controller 70. The buffer unit 71 outputs the data of a line corresponding to the positions of the respective L nozzle orifices 36 in the sub-scanning direction in the Y-plate image data to the L signal generating units 76Y-1 to 76Y-L for Y in accordance with the control by the scan controller 70.

In the present embodiment, the timing generating unit 74 generates N timing signals with phases shifted by 1/N cycle each with respect to the occurrence cycle of the pulse of the position signal. In the present embodiment, N=4. The timing generating unit 74 gives the first timing signal with no phase shift from the position signal to the signal output units 77K-1 to 77K-L for K. The timing generating unit 74 gives the second timing signal with a phase shifted from the position signal by ¼ cycle to the signal output units 77C-1 to 77C-L for C. The timing generating unit 74 gives the third timing signal with a phase shifted from the position signal by ½ cycle to the signal output units 77M-1 to 77M-L for M. The timing generating unit 74 gives the fourth timing signal with a phase shifted from the position signal by ¾ cycle to the signal output units 77Y-1 to 77Y-L for Y.

The mask generating unit 75, correspondingly with each of the signal generating units 76K-1 to 76K-L for K, generates a mask pattern for extracting the pixel value of the position of the corresponding nozzle orifice 36 from the K-plate image data output from the buffer unit 71. The mask generating unit 75, correspondingly with each of the signal generating units 76C-1 to 76C-L for C, generates a mask pattern for extracting the pixel value of the position of the corresponding nozzle orifice 36 from the C-plate image data output from the buffer unit 71. The mask generating unit 75, correspondingly with each of the signal generating units 76M-1 to 76M-L for M, generates a mask pattern for extracting the pixel value of the position of the corresponding nozzle orifice 36 from the M-plate image data output from the buffer unit 71. The mask generating unit 75, correspondingly with each of the signal generating units 76Y-1 to 76Y-L for Y, generates a mask pattern for extracting the pixel value of the position of the corresponding nozzle orifice 36 from the Y-plate image data output from the buffer unit 71.

Each of the signal generating units 76K-1 to 76K-L for K extracts the pixel of a line of the corresponding nozzle orifice 36 from the K-plate image data output from the buffer unit 71 based on the mask pattern generated by the mask generating unit 75 and generates recording pixel data indicating the value of the extracted pixel. Each of the signal generating units 76C-1 to 76C-L for C extracts the pixel of a line of the corresponding nozzle orifice 36 from the C-plate image data output from the buffer unit 71 based on the mask pattern generated by the mask generating unit 75 and generates recording pixel data indicating the value of the extracted pixel.

Each of the signal generating units 76M-1 to 76M-L for M extracts the pixel of a line of the corresponding nozzle orifice 36 from the M-plate image data output from the buffer unit 71 based on the mask pattern generated by the mask generating unit 75 and generates recording pixel data indicating the value of the extracted pixel. Each of the signal generating units 76Y-1 to 76Y-L for Y extracts the pixel of a line of the corresponding nozzle orifice 36 from the Y-plate image data output from the buffer unit 71 based on the mask pattern generated by the mask generating unit 75 and generates recording pixel data indicating the value of the extracted pixel.

The signal output units 77K-1 to 77K-L for K receive inputs of the first timing signal and the recording pixel data generated by the respective signal generating units 76K-1 to 76K-L for K. The signal output units 77K-1 to 77K-L for K output respective recording signals for K of a level corresponding to the respective recording pixel data at a timing of the first timing signal.

The signal output units 77C-1 to 77C-L for C receive inputs of the second timing signal and the recording pixel data generated by the respective signal generating units 76C-1 to 76C-L for C. The signal output units 77C-1 to 77C-L for C output respective recording signals for C of a level corresponding to the respective recording pixel data at a timing of the second timing signal.

The signal output units 77M-1 to 77M-L for M receives inputs of the third timing signal and the recording pixel data generated by the respective signal generating units 76M-1 to 76M-L for M. The signal output units 77M-1 to 77M-L for M output respective recording signals for M of a level corresponding to the respective recording pixel data at a timing of the third timing signal.

The signal output units 77Y-1 to 77Y-L for Y receive inputs of the fourth timing signal and the recording pixel data generated by the respective signal generating units 76Y-1 to 76Y-L for Y. The signal output units 77Y-1 to 77Y-L for Y output respective recording signals for Y of a level corresponding to the respective recording pixel data at a timing of the fourth timing signal.

The controller 66 supplies the recording signals for K, the recording signals for C, the recording signals for M, the recording signals for Y to the head drive unit 61 and discharges pieces of ink of the respective colors from the respective nozzle orifices 36.

Figure 11:
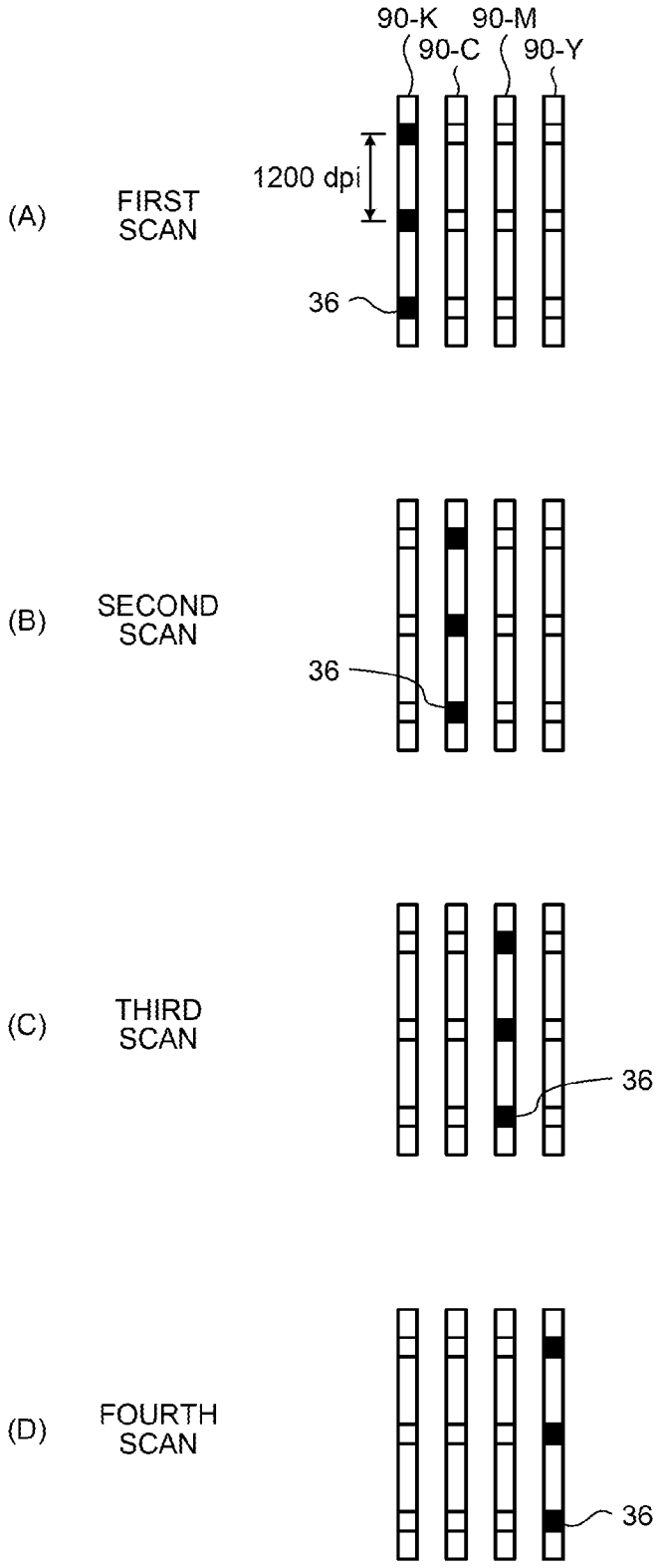
FIG. 11 that includes parts A to D is diagram illustrating examples of nozzles used in respective scans in the second embodiment.

FIG. 11 is diagram illustrating examples of nozzles used in respective scans. In the present embodiment, the scan controller 70 controls each of the units so as to scan the same position in the sub-scanning direction on the sheet N times (four times in the present embodiment) in the main-scanning direction to discharge ink droplets from the nozzle orifices 36.

Specifically, in the first scan, as illustrated in the part A in FIG. 11, the scan controller 70 discharges the K-color ink from the L nozzle orifices 36 contained in the nozzle unit 90-K for K. In the second scan, as illustrated in the part B in FIG. 11, the scan controller 70 discharges the C-color ink from the L nozzle orifices 36 contained in the nozzle unit 90-C for C.

In the third scan, as illustrated in the part C in FIG. 11, the scan controller 70 discharges the M-color ink from the L nozzle orifices 36 contained in the nozzle unit 90-M for M. In the fourth scan, as illustrated in the part D in FIG. 11, the scan controller 70 discharges the Y-color ink from the L nozzle orifices 36 contained in the nozzle unit 90-Y for Y.

Figure 12:
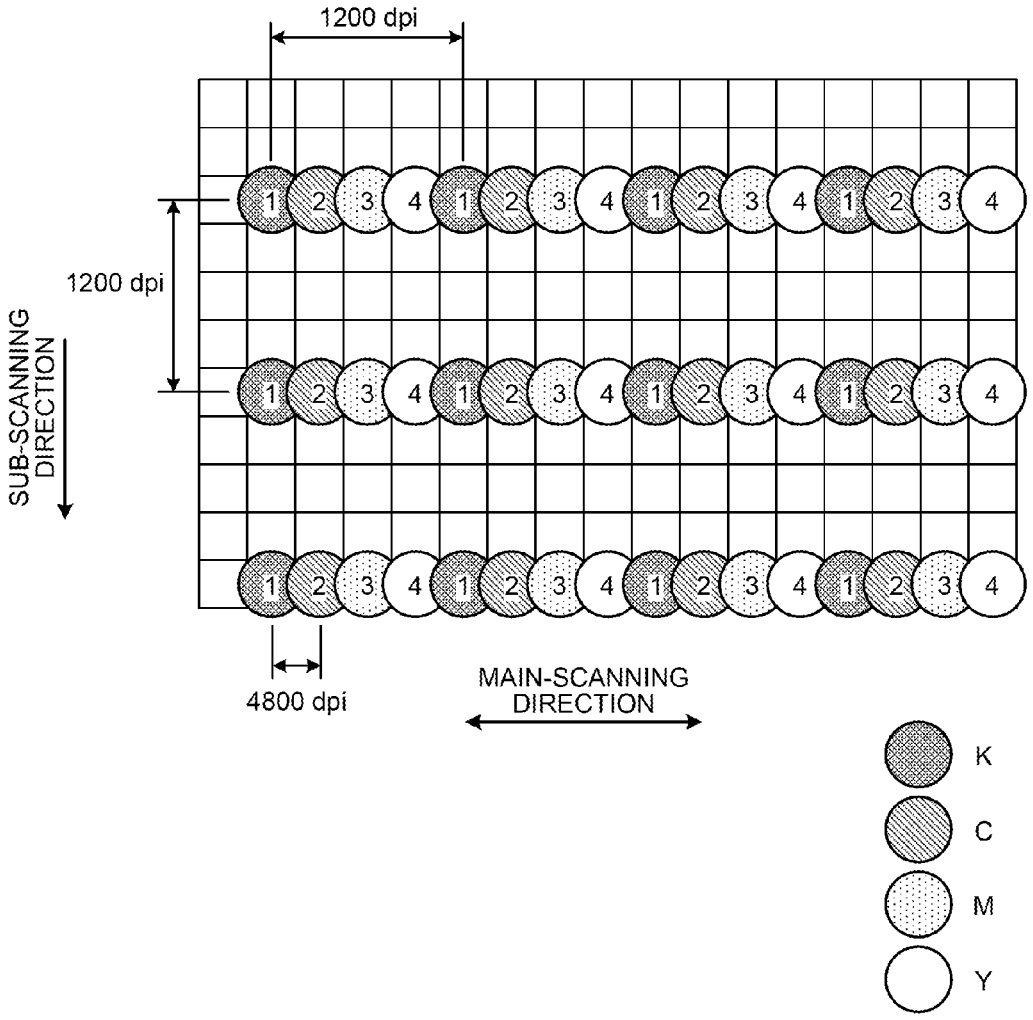
FIG. 12 is a diagram illustrating a pattern of dots formed on a sheet in the second embodiment.

FIG. 12 is a diagram illustrating a pattern of dots formed on a sheet in the second embodiment. For the sub-scanning direction, the image forming apparatus 10 according to the present embodiment can form dots at an interval (an interval corresponding to 1,200 dpi) of the nozzle orifices 36 in the sub-scanning direction.

For the main-scanning direction, the image forming apparatus 10 according to the present embodiment can record dots of K, C, M, and Y in this order, each of the dots being shifted by an interval (4,800 dpi) of ¼ of the cycle of the graduations on the scale 67 of the main-scanning encoder 63. This recording enables the image forming apparatus 10 according to the present embodiment to form dots with density four times the graduations on the scale 67 of the main-scanning encoder 63 with respect to the main-scanning direction.

Thus, the image forming apparatus 10 according to the present embodiment can improve the recording density in the main-scanning direction without changing the main-scanning encoder 63. This improvement enables the image forming apparatus 10 to improve the recording density in the main-scanning direction at low cost. Furthermore, the image forming apparatus 10 according to the present embodiment shifts the dot formation position by color, thereby enabling the colors to be represented with high resolution.

Third Embodiment

Next, the image forming apparatus 10 according to the third embodiment will be described. Because the image forming apparatus 10 according to the third embodiment has substantially the same configuration as that of the second embodiment, components having substantially the same functions will be referred to by the same reference numerals, and the description thereof will be omitted except for points of difference.

Figure 13:
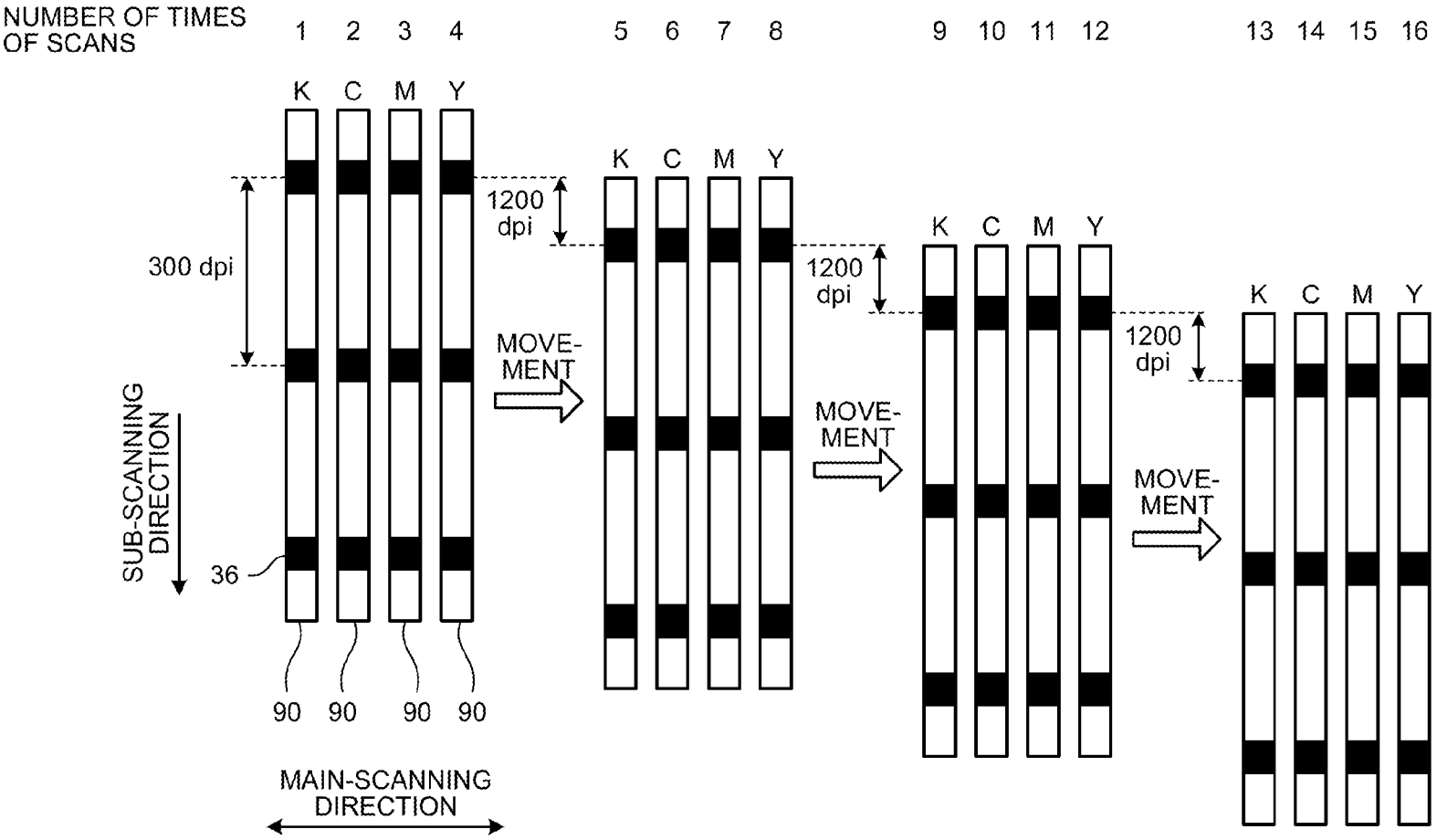
FIG. 13 is a diagram illustrating examples of nozzles used in respective scans in a third embodiment.

FIG. 13 is a diagram illustrating examples of nozzles used in respective scans in the third embodiment. In the third embodiment, the interval of the L nozzle orifices 36 contained in the nozzle units 90 in the sub-scanning direction is an interval corresponding to 1/P (P is an integer of 2 or larger) of the accuracy of the sub-scanning encoder 65. In other words, the interval of the L nozzle orifices 36 in the sub-scanning direction is an interval larger than the accuracy of the sub-scanning encoder 65. The sub-scanning controller 73 therefore controls the movement of the sheet with respect to the sub-scanning direction with a distance unit smaller than the interval of the nozzle orifices 36 in the sub-scanning direction.

In the third embodiment, the scan controller 70 repeats processing P times to move the sheet in the sub-scanning direction by an interval corresponding to the accuracy of the sub-scanning encoder 65 and scan the same position in the sub-scanning direction on the sheet N times in the main-scanning direction. This processing enables the image forming apparatus 10 to form an image by a distance corresponding to the length of the L nozzle orifices 36 on the sheet.

When N=4, P=4, and the accuracy of the sub-scanning encoder 65 is a length corresponding to 1,200 dpi, for example, the interval of the L nozzle orifices 36 contained in the nozzle units 90 is a length corresponding to 300 dpi. In this case, the scan controller 70, after moving the sheet in the sub-scanning direction by a length corresponding to 1,200 dpi, causes the head 34 to perform scans N times (four times) at the same position in the sub-scanning direction. The scan controller 70 repeats this processing P times (four times). This processing causes the scan controller 70 to repeat scans N×P=16 times. This processing enables the image forming apparatus 10 to form an image by a length of 300 dpi×L in the sub-scanning direction on the sheet.

Figure 14:
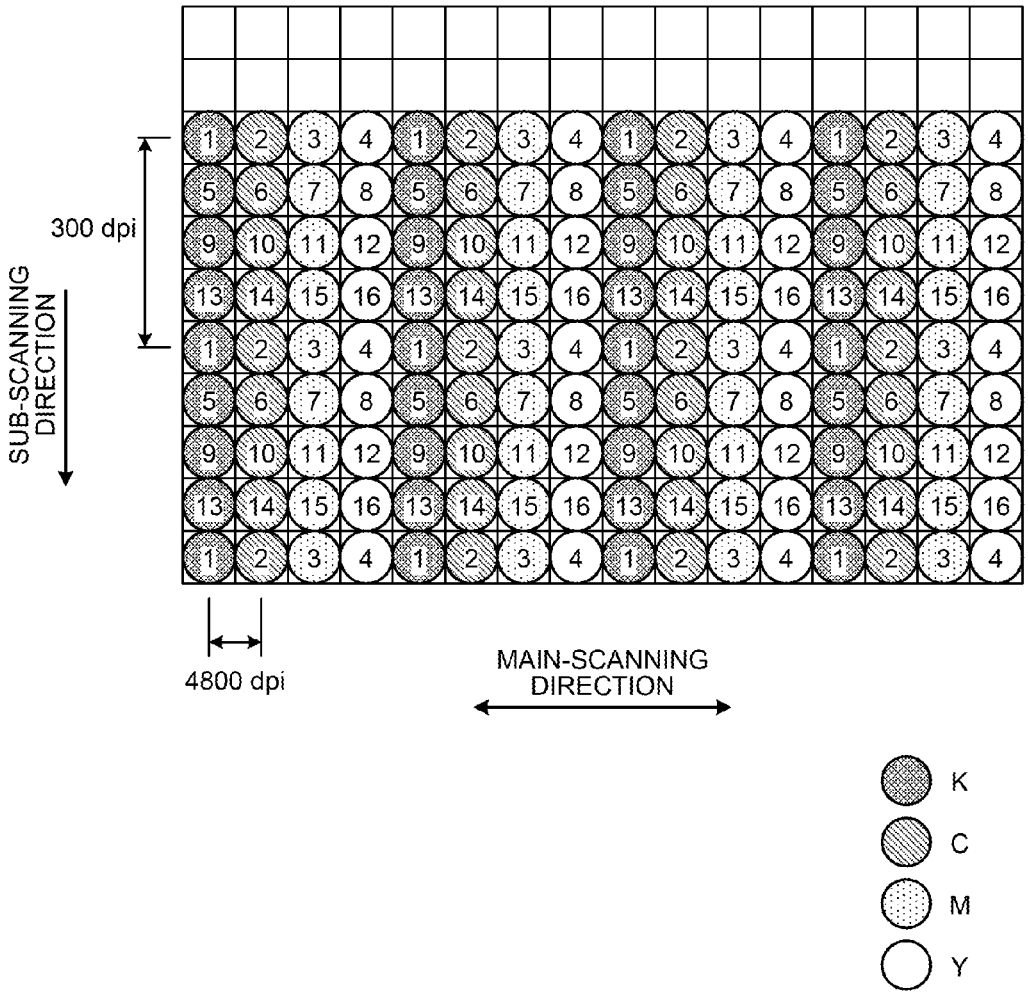
FIG. 14 is a diagram illustrating a first pattern of dots formed on a sheet in the third embodiment.

FIG. 14 is a diagram illustrating a first pattern of dots formed on a sheet in the third embodiment. For the sub-scanning direction, the image forming apparatus 10 according to the present embodiment can form dots at an interval of 1/P of the interval of the nozzle orifices 36 in the sub-scanning direction, that is, at an interval (an interval corresponding to 1,200 dpi) corresponding to the accuracy of the sub-scanning encoder 65.

For the main-scanning direction, the image forming apparatus 10 according to the present embodiment can record dots of K, C, M, and Y in this order, each of the dots being shifted by an interval (4,800 dpi) of ¼ of the cycle of the graduations on the scale 67 of the main-scanning encoder 63. This recording enables the image forming apparatus 10 to form dots with density four times the graduations on the scale 67 of the main-scanning encoder 63 with respect to the main-scanning direction.

Thus, the image forming apparatus 10 according to the present embodiment can improve the recording density in the main-scanning direction without changing the main-scanning encoder 63. This improvement enables the image forming apparatus 10 to improve the recording density in the main-scanning direction at low cost. Furthermore, the image forming apparatus 10 according to the present embodiment shifts the dot formation position by color, thereby enabling the colors to be represented with high resolution.

Figure 15:
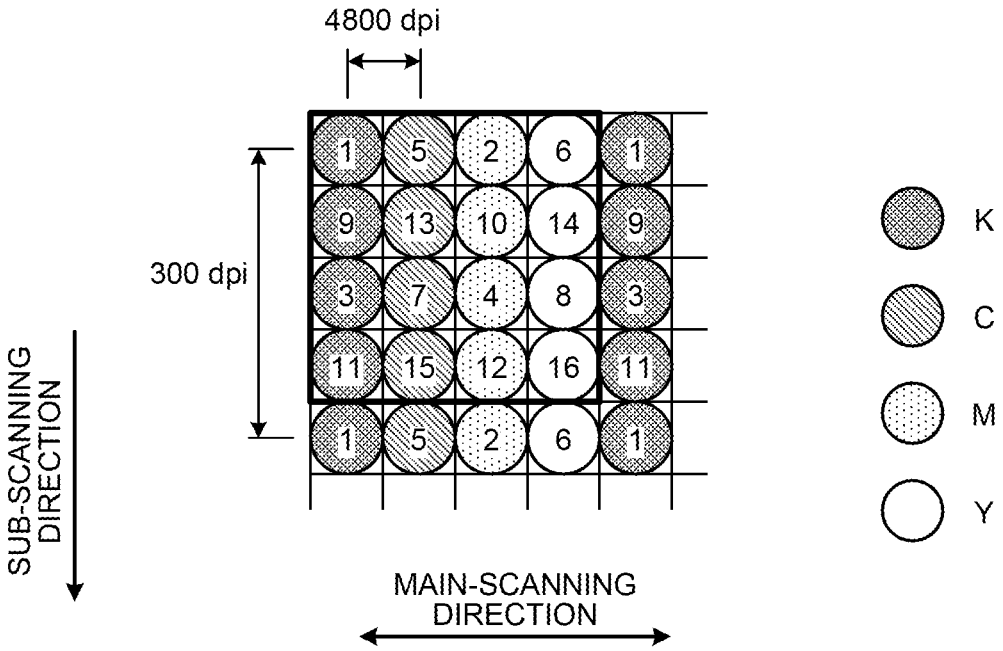
FIG. 15 is a diagram illustrating a second pattern of dots formed on a sheet in the third embodiment.

FIG. 15 is a diagram illustrating a second pattern of dots formed on a sheet in the third embodiment. The scan controller 70 can move the sheet to any position in the sub-scanning direction as long as the distance of the movement is an integral multiple of the detection accuracy of the sub-scanning encoder 65. The scan controller 70 can cause the head 34 to perform scans any number of times in the main-scanning direction at the same position in the sub-scanning direction.

The signal generating unit 76 generates recording pixel data of a pattern that causes the nozzle orifices 36 to discharge ink liquids in an order not forming adjacent dots in two consecutive scans. For example, the signal generating unit 76 generates the recording pixel data that forms dots with a pattern in which ink droplets are discharged in such an order as illustrated in FIG. 15.

In this case, the scan controller 70 controls the movement of the head 34 in the sub-scanning direction and the number of times of scans of the head 34 at the same position in the sub-scanning direction so that dots are formed on the sheet with such a pattern as illustrated in FIG. 15. The mask generating unit 75 stores therein a plurality of mask patterns corresponding to the movements in the sub-scanning direction and the scan pattern in advance, selects an appropriate mask pattern in accordance with the position and the number of scans of the head 34, and gives the mask pattern to the signal generating unit 76.

This processing enables the image forming apparatus 10 according to the third embodiment to prevent the occurrence of blurring on color boundaries caused by mutual attraction of dots formed on the sheet and the occurrence of irregularities of ink while being dried (color irregularities) called beading.

In FIG. 15, for example, the dot formed by the fifth scan is returned from the dot formed by the fourth scan in the reverse direction of the sub-scanning direction. However, the nozzle units 90 arrange a plurality of respective nozzle orifices 36 in the sub-scanning direction, and the position of the nozzle orifice 36 used for the area of the dot formed by the fifth scan is returned in the reverse direction of the sub-scanning direction within the nozzle unit 90, thereby enabling dots to be formed in an order including the part returned in the reverse direction of the sub-scanning direction without moving the sheet in the reverse direction.

Fourth Embodiment

Next, the image forming apparatus 10 according to the fourth embodiment will be described. Because the image forming apparatus 10 according to the fourth embodiment has substantially the same configuration as that of the second embodiment, components having substantially the same functions will be referred to by the same reference numerals, and the description thereof will be omitted except for points of difference.

Figure 16:
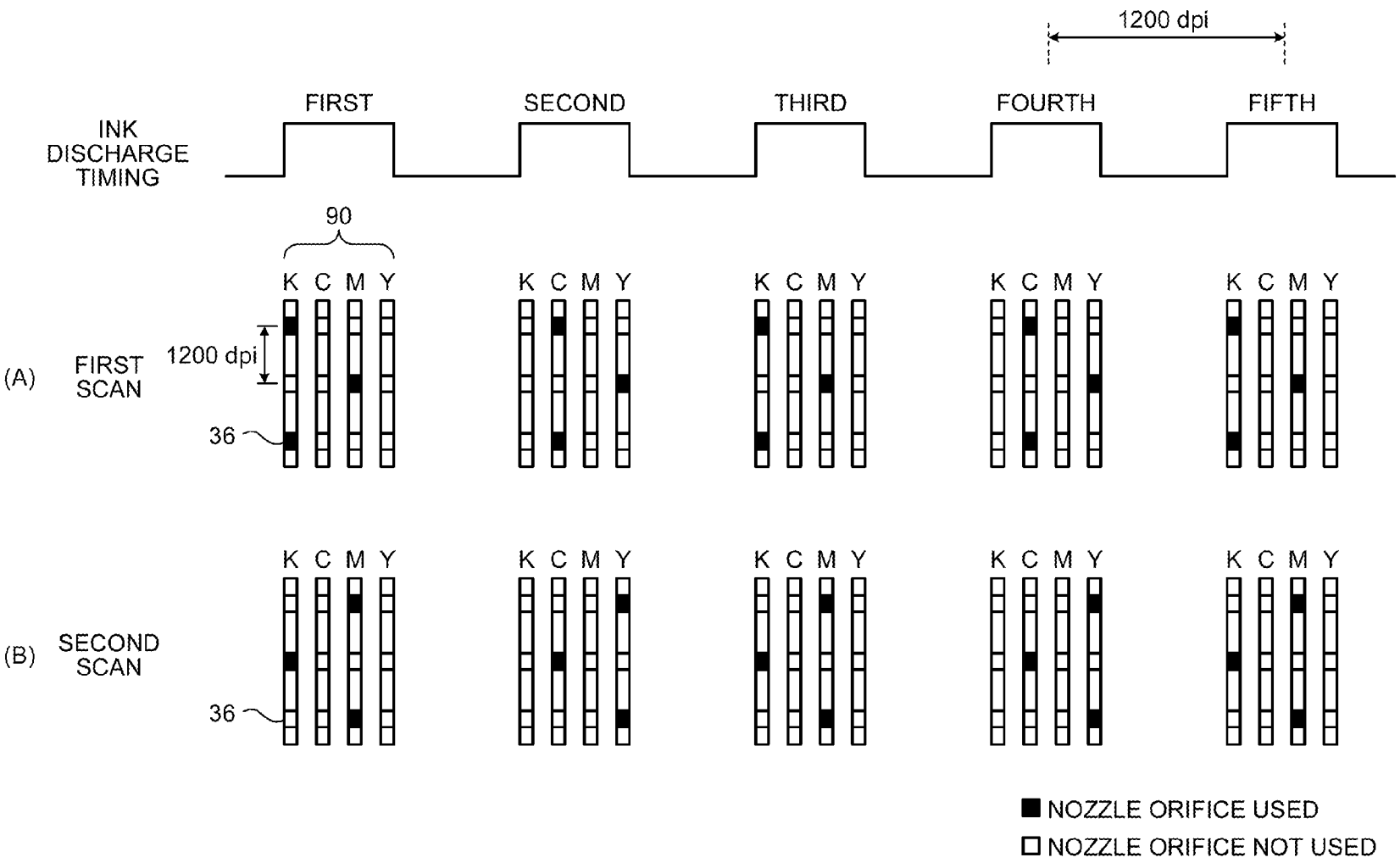
FIG. 16 that includes parts A and B is diagram illustrating examples of nozzles used in respective scans in a fourth embodiment.

FIG. 16 is diagram illustrating examples of nozzles used in respective scans in the fourth embodiment. In the fourth embodiment, the interval of the L nozzle orifices 36 in the sub-scanning direction contained in the nozzle unit 90 is an interval (an interval corresponding to 1,200 dpi in the present embodiment) corresponding to the accuracy of the sub-scanning encoder 65. In the present embodiment, the signal generating unit 76 forms dots on the sheet using the L nozzle orifices 36 in one scan.

In the present embodiment, the signal generating unit 76 forms dots on the sheet using the nozzle orifices 36 contained in the nozzle units 90 simultaneously. In this case, the signal generating unit 76 uses only one nozzle orifice 36 for the same line in the sub-scanning direction. Concurrently therewith, the signal generating unit 76 uses the nozzle orifices 36 of only one color plate for the same ink discharge timing in the main-scanning direction.

For example, it is assumed that the head 34 has four nozzle units 90 for K, C, M, and Y. In this case, as illustrated in the part A in FIG. 16, the signal generating unit 76 selects and uses every other nozzle orifices 36 of the L/2 nozzle orifices 36 among the L ones contained in the nozzle unit 90-K for K in the sub-scanning direction in a first scan. In the first scan, the signal generating unit 76 uses the nozzle orifices 36 contained in the nozzle unit 90-K for K at every other ink discharge timing in the main-scanning direction.

As illustrated in the part A in FIG. 16, in the first scan, the signal generating unit 76 uses L/2 nozzle orifices 36 on a line not used in the nozzle unit 90-K for K among the L ones contained in the nozzle unit 90-M for M. In the first scan, the signal generating unit 76 uses the nozzle orifices 36 contained in the nozzle unit 90-M for M at the same ink discharge timing as that of the nozzle unit 90-K for K in the main-scanning direction.

As illustrated in the part A in FIG. 16, the signal generating unit 76 selects and uses every other nozzle orifices 36 of the L/2 nozzle orifices 36 among the L ones contained in the nozzle unit 90-C for C in the sub-scanning direction in the first scan. In the first scan, the signal generating unit 76 uses the nozzle orifices 36 contained in the nozzle unit 90-C for C at different ink discharge timing from that of the nozzle unit 90-K for K in the main-scanning direction.

As illustrated in the part A in FIG. 16, in the first scan, the signal generating unit 76 selects and uses L/2 nozzle orifices 36 on a line not used in the nozzle unit 90-C for C among the L ones contained in the nozzle unit 90-Y for Y. In the first scan, the signal generating unit 76 uses the nozzle orifices 36 contained in the nozzle unit 90-Y for Y at the same ink discharge timing as that of the nozzle unit 90-C for C in the main-scanning direction.

As illustrated in the part B in FIG. 16, in a second scan, the signal generating unit 76 uses the nozzle orifices 36 not used in the first scan among the nozzle orifices 36 of the respective four nozzle units 90 for K, C, M, and Y at different ink discharge timing from that in the first scan. Thereafter, the signal generating unit 76 repeats the same processing as that of the first scan and the second scan.

Figure 17:
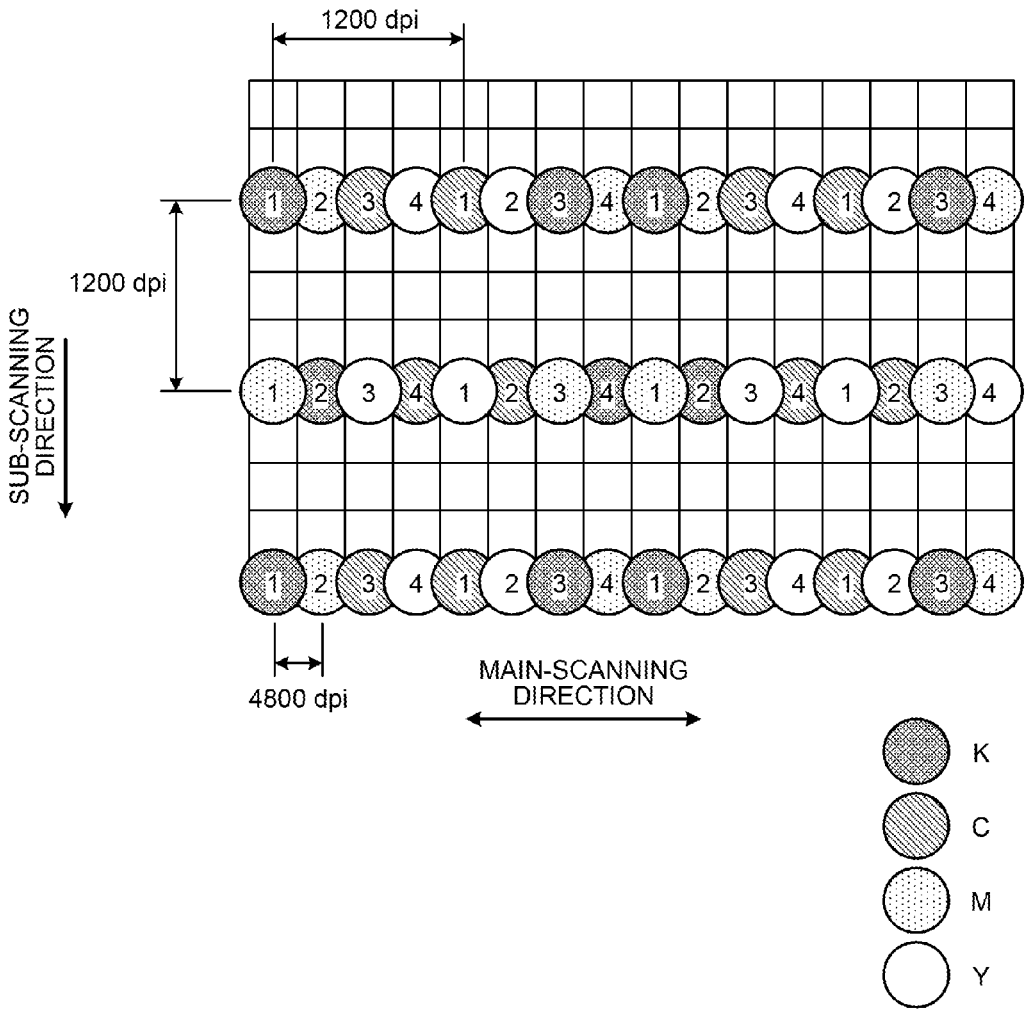
FIG. 17 is a diagram illustrating a first pattern of dots formed on a sheet in the fourth embodiment.

FIG. 17 is a diagram illustrating a first pattern of dots formed on a sheet in the fourth embodiment. For the sub-scanning direction, the image forming apparatus 10 according to the present embodiment can form dots at the interval (an interval corresponding to 1,200 dpi) of the nozzle orifices 36 in the sub-scanning direction.

The pattern of ink droplets formed on the sheet differs by line. As illustrated in FIG. 17, for example, a pattern is formed in which a line formed with dots in the order of K, M, C, and Y from left in the main-scanning direction and a line formed with dots in the order of M, K, Y, and C from left in the main-scanning direction are alternately arranged in the sub-scanning direction.

Thus, the image forming apparatus 10 according to the present embodiment can reduce the number of the nozzle orifices 36 that discharge ink droplets from one nozzle unit 90 in one scan in each of the main-scanning direction and the sub-scanning direction. The image forming apparatus 10 can therefore eliminate an imbalance among the nozzle orifices 36 used in one scan and stably discharge ink droplets.

Figure 18:
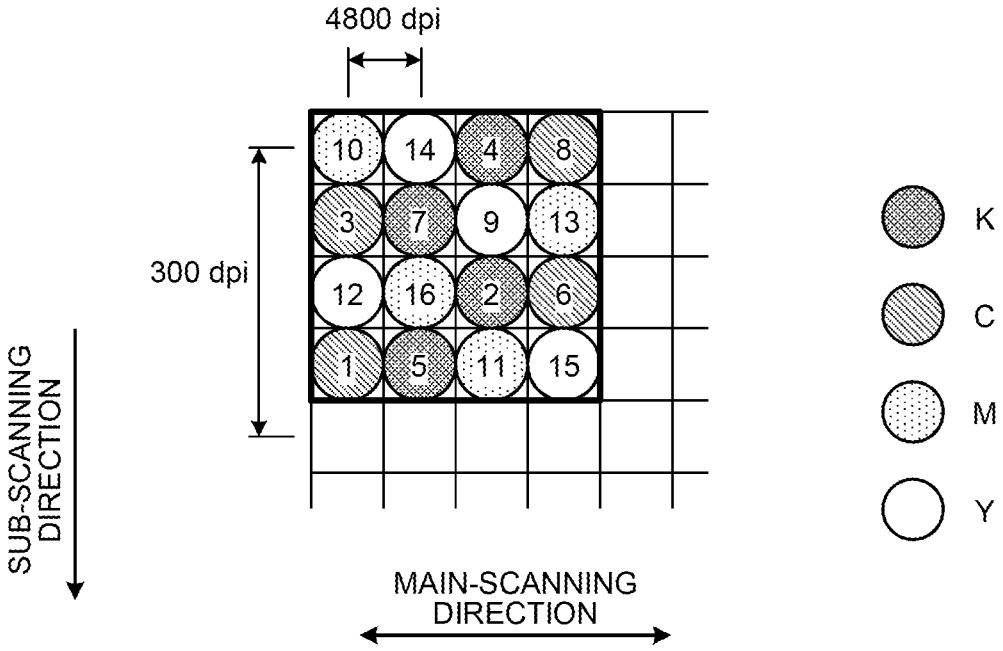
FIG. 18 is a diagram illustrating a second pattern of dots formed on a sheet in the fourth embodiment.

FIG. 18 is a diagram illustrating a second pattern of dots formed on a sheet in the fourth embodiment. In the fourth embodiment, the interval of the L nozzle orifices 36 contained in the nozzle units 90 in the sub-scanning direction may be an interval (300 dpi, for example) corresponding to 1/P (P is an integer of 2 or larger) of the accuracy of the sub-scanning encoder 65.

In this case, the signal generating unit 76 may generate recording pixel data of a pattern that causes the nozzle orifices 36 to discharge ink droplets in an order not forming adjacent dots in two consecutive scans. For example, the signal generating unit 76 may generate the recording pixel data of a pattern that causes ink droplets to be discharged in such an order as illustrated in FIG. 18 for an area of 4×4 dots containing four dots (K, C, M, Y) in the main-scanning direction and four lines in the sub-scanning direction on the sheet.

This generation enables the image forming apparatus 10 according to the fourth embodiment to prevent the occurrence of blurring on color boundaries caused by mutual attraction of dots formed on the sheet and the occurrence of irregularities of ink while being dried (color irregularities) called beading.

Figure 19:
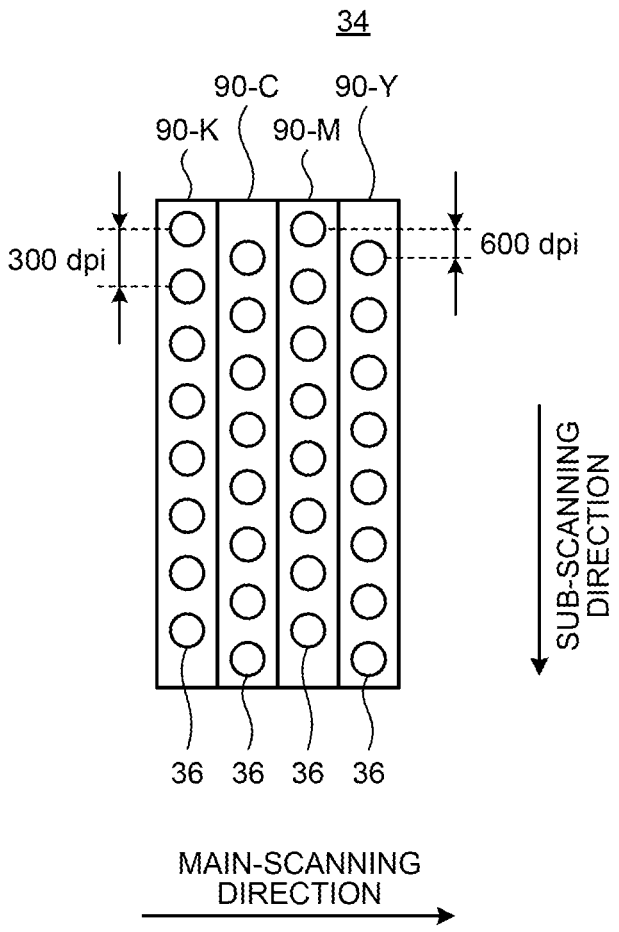
FIG. 19 is a diagram illustrating another configuration example of nozzle orifices formed in a head.

FIG. 19 is a diagram illustrating another configuration example of the nozzle orifices 36 formed in the head 34. The L nozzle orifices 36 formed in a plurality of nozzle units 90 may be arranged by being shifted in the sub-scanning direction as illustrated in FIG. 19.

For example, the positions of the L nozzle orifices 36 formed in the nozzle unit 90-K for K and the positions of the L nozzle orifices 36 formed in the nozzle unit 90-C for C may be shifted from each other. In the present embodiment, the interval of the nozzle orifices 36 in the sub-scanning direction is a length corresponding to 300 dpi, whereas the amount of shift between the adjacent nozzle units 90 is a length corresponding to 600 dpi.

By shifting the nozzle units 90 as described above, the controller 66 can reduce the number of times of moving the sheet in the sub-scanning direction and perform efficient printing when, for example, dots are formed in such patterns as illustrated in FIG. 15 and FIG. 18.

Although the image forming apparatus of the inkjet system has been described as the embodiments, the present invention can also be applied to droplet discharge apparatuses of other configurations that discharge special liquids such as coloring material liquids for use in the manufacture of color filters for liquid crystal displays and electrode liquid materials for use in the manufacture of electrode films for organic electro luminescence (EL) displays.

Examples of the ink droplets discharged from the nozzle orifices 36 include, but not limited to, liquids (including dispersion liquids such as suspensions and emulsions) containing various kinds of materials. Specific examples of the liquids include ink containing filter materials of color filters, light-emitting materials for forming EL light-emitting layers in organic EL devices, fluorescent materials for forming fluorescent bodies on electrodes in electron emission devices, fluorescent materials for forming fluorescent bodies in plasma display panel (PDP) devices, migration body materials for forming migration bodies in electrophoresis display apparatuses, bank materials for forming banks on substrates W, various kinds of coating materials, liquid electrode material for forming electrodes, particulate materials for forming spacers for forming a minute cell gap between two substrates, liquid metallic materials for forming metallic wiring, lens materials for forming microlenses, resist materials, light diffusion materials for forming light diffusers, and various kinds of test liquid materials for use in biosensors such as DNA chips and protein chips.

Examples of droplet receivers onto which droplets are discharged include, but not limited to paper such as recording sheets, other media such as films, woven cloth, and unwoven cloth and pieces of work such as various substrates such as glass substrates and silicon substrates.

The present invention can improve recording density in the main-scanning direction at low cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image on a recording medium by discharging ink droplets onto the recording medium, the image forming apparatus comprising:

a head comprising L (L is an integer of 2 or larger) nozzle orifices that discharge ink droplets of different colors onto the recording medium;

a main-scanning controller that controls movement of the head in a main-scanning direction;

a main-scanning encoder that generates a position signal indicating the position of the head in the main-scanning direction, at a certain interval;

a timing generating unit that generates a timing signal with a phase shifted from the position signal;

a signal output unit that outputs a recording signal of a waveform pattern corresponding to image data at a timing of the timing signal;

a head drive unit that discharges ink droplets from the nozzle orifices in accordance with the recording signal; and a scan controller that controls the main-scanning controller so as to cause the nozzle orifices to perform scans N (N is an integer of 2 or larger) times in the main-scanning direction at the same position in a sub-scanning direction orthogonal to the main-scanning direction, wherein the timing generating unit generates timing signals having different phases for each of the N scans at the same position in the sub-scanning direction, and the scan controller causes, for said each of the N scans, ink droplets of plural different colors to be discharged from the nozzle orifices at the same position in the sub-scanning direction.

2. The image forming apparatus according to claim 1, wherein the main-scanning controller moves the head at a predetermined speed in the main-scanning direction, and the timing generating unit generates the timing signal by delaying the position signal by a period of time shorter than a cycle in which the head detects the certain interval.

3. The image forming apparatus according to claim 1, wherein the timing generating unit generates timing signals with phases shifted by 1/N cycle each with respect to the cycle of the position signal for the respective N scans at the same positions in the sub-scanning direction.

4. An image forming apparatus that forms an image on a recording medium by discharging ink droplets onto the recording medium, the image forming apparatus comprising:

a head having a nozzle orifice that discharges ink droplets onto the recording medium;

a main-scanning controller that controls movement of the head in a main-scanning direction;

a main-scanning encoder that generates a position signal indicating a position of the head in the main-scanning direction, at a certain interval;

a timing generating unit that generates a timing signal with a phase shifted from the position signal, the timing generating unit generating timing signals with phases shifted by 1/N (N is an integer of 2 or larger) cycles each with respect to the cycle of the position signal for the respective N scans at the same positions in the sub-scanning direction;

a signal output unit that outputs a recording signal of a waveform pattern corresponding to image data at a timing of the timing signal; and a head drive unit that discharges ink droplets from the nozzle orifice in accordance with the recording signal;

a scan controller that controls the main-scanning controller so as to cause the nozzle orifice to perform scans N times in the main-scanning direction at the same position in a sub-scanning direction orthogonal to the main-scanning direction, a signal generating unit that extracts a pixel corresponding to the phase of the timing signal from image data of a line corresponding to the position of the nozzle orifice in the sub-scanning direction and generates recording pixel data indicating the value of the extracted pixel for each of the N scans at the same positions in the sub-scanning direction, wherein the signal generating unit generates the recording signal of a waveform pattern corresponding to the recording pixel data.

5. The image forming apparatus according to claim 4, wherein the head comprises plural nozzle units that discharge ink droplets of different colors, each of the plural nozzle units comprises L (L is an integer of 2 or larger) nozzle orifices that are arranged at least in a row at a certain interval in the sub-scanning direction, the plural nozzle units are arranged in the main-scanning direction, and the head drive unit causes, for each of the N scans, ink droplets of different colors to be discharged from one of the nozzle orifices at the same position in the sub-scanning direction.

6. The image forming apparatus according to claim 5, further comprising a sub-scanning controller that controls the movement of the recording medium with respect to the sub-scanning direction with a distance unit shorter than the interval of the nozzle orifices in the sub-scanning direction.

7. The image forming apparatus according to claim 6, wherein the signal generating unit generates the recording pixel data of a pattern that causes ink droplets corresponding to two adjacent pixels not to be discharged in two consecutive scans.

8. The image forming apparatus according to claim 5, wherein the signal generating unit generates the recording pixel data of a pattern that causes ink droplets to be discharged from the L nozzle orifices using the nozzle orifices contained in the nozzle units simultaneously in one scan.

9. An image forming method executed by an image forming apparatus that forms an image on a recording medium by discharging ink droplets onto the recording medium, the image forming apparatus comprising:

a head comprising L (L is an integer of 2 or larger) nozzle orifices that discharge ink droplets of different colors onto the recording medium;

a main-scanning controller that controls the movement of the head in a main-scanning direction;

a main-scanning encoder that generates a position signal indicating the position of the head in the main-scanning direction at a certain interval, and a scan controller that controls the main-scanning controller so as to cause the nozzle orifices to perform scans N times in the main-scanning direction at the same position in a sub-scanning direction orthogonal to the main-scanning direction, the image forming method comprising:

generating a timing signal with a phase shifted from the position signal;

outputting a recording signal of a waveform pattern corresponding to image data at a timing of the timing signal; and discharging, for each of the N scans at the same position in the sub-scanning direction, ink droplets of plural different colors from the nozzle orifices, in accordance with the recording signal.

10. Printed matter on which an image is formed by the image forming method according to claim 9.

11. An image forming method executed by an image forming apparatus that forms an image on a recording medium by discharging ink droplets onto the recording medium, the image forming method comprising:

controlling movement of a recording head of the image forming apparatus in a main-scanning direction;

generating, by a main-scanning encoder of the image forming apparatus, a position signal indicating a position of the recording head in the main-scanning direction, at a certain interval;

generating, by a timing generating unit of the image forming apparatus, a timing signal with a phase shifted from the position signal, and generating timing signals with phases shifted by 1/N (N is an integer of 2 or larger) cycles each with respect to the cycle of the position signal for the respective N scans at the same positions in the sub-scanning direction;

outputting a recording signal of a waveform pattern corresponding to image data at a timing of the timing signal; and discharging ink droplets through a nozzle orifice of the recording head in accordance with the recording signal;

controlling the movement of the recording head so as to cause the nozzle orifice to perform scans N times in the main-scanning direction at the same position in a sub-scanning direction orthogonal to the main-scanning direction, extracting, by a signal generating unit of the image forming apparatus, a pixel corresponding to the phase of the timing signal from image data of a line corresponding to the position of the nozzle orifice in the sub-scanning direction, and generating recording pixel data indicating the value of the extracted pixel for each of the N scans at the same positions in the sub-scanning direction, and generating, by the signal generating unit, the recording signal of a waveform pattern corresponding to the recording pixel data.

* * * * *